US007541538B1

(12) United States Patent
Sosna et al.

(10) Patent No.: US 7,541,538 B1
(45) **Date of Patent: *Jun. 2, 2009**

(54) MULTICONDUCTOR CABLE STRUCTURES

(76) Inventors: Howard Jay Sosna, 847 W. Mountain Rd., Sparta, NJ (US) 07871; Joseph Kubala, Jr., 48 McNab Ave., Cedar Knolls, NJ (US) 07927; Verne Edwin Searer, 1000 W. Marion St., Elkhart, IN (US) 46516

( * ) Notice: Subject to any disclaimer, the term of this patent is extended or adjusted under 35 U.S.C. 154(b) by 0 days.

This patent is subject to a terminal disclaimer.

(21) Appl. No.: 12/217,649

(22) Filed: Jul. 8, 2008

Related U.S. Application Data

(62) Division of application No. 11/196,598, filed on Aug. 3, 2005, now Pat. No. 7,446,258.

(60) Provisional application No. 60/598,754, filed on Aug. 4, 2004.

(51) Int. Cl.
*H01B 11/02* (2006.01)

(52) U.S. Cl. ..... 174/33; 174/36

(58) Field of Classification Search ..... 174/33, 174/34, 36, 113 R
See application file for complete search history.

(56) References Cited

U.S. PATENT DOCUMENTS

| | | | | |
|---|---|---|---|---|
| 1,818,027 | A | 8/1931 | Affel et al. | |
| 3,309,455 | A | 3/1967 | Mildner | |
| 4,538,023 | A | 8/1985 | Brisson | |
| 4,628,151 | A | 12/1986 | Cardas | |
| 4,767,890 | A | 8/1988 | Magnan | |
| 4,945,189 | A | 7/1990 | Palmer | |
| 4,980,517 | A | 12/1990 | Cardas | |
| 5,064,966 | A | 11/1991 | Palmer | |
| 5,109,140 | A | 4/1992 | Nguyen | |
| 5,110,999 | A | 5/1992 | Barbera | |
| 5,266,744 | A | 11/1993 | Fitzmaurice | |
| 5,376,758 | A | 12/1994 | Kimber | |
| 6,005,193 | A | 12/1999 | Markel | |
| 6,066,799 | A | 5/2000 | Nugent | |
| 6,388,188 | B1 | 5/2002 | Harrison | |
| 6,570,087 | B2 | 5/2003 | Navone et al. | |
| 6,658,119 | B1 | 12/2003 | Brisson et al. | |
| 7,446,258 | B1 * | 11/2008 | Sosna et al. | 174/33 |

* cited by examiner

*Primary Examiner*—Chau N Nguyen
(74) *Attorney, Agent, or Firm*—David L. Banner

(57) ABSTRACT

There are provided cable architectures useful for constructing high-performance audio interconnection cables. Multiple, parallel runs of multiconductor, shielded, twisted pair cable are used to construct both balanced and unbalanced interconnect cables, speaker cables, and power cords. Conductors from each cable run are separated and connected to other conductors from other runs to form composite signal and ground conductors. Shields may be selectively connected to one another and to appropriate pins or terminals of a terminating connector. An overall mother shield may, optionally, be added. Individual runs of cable are braided together. Cables constructed in accordance with the geometries and techniques of the invention sound better than any known cables of the prior art. When measured, the inventive cables exhibit a ratio of capacitance to inductance that is lower that prior art cables. The characteristic impedance of the inventive cables is also lower than cables of the prior art.

12 Claims, 28 Drawing Sheets

Note: No shield is connected to Pin 1 at either connector.

MULTICONDUCTOR CABLE STRUCTURES

RELATED APPLICATIONS

This application is a Divisional application of U.S. patent application Ser. No. 11/196,598 filed Aug. 3, 2005 now U.S. Pat. No. 7,446,258 which claims priority in accordance with 37 C.F.R. §119(e) to U.S. Provisional Patent Application Ser. No. 60/598,754 filed Aug. 4, 2004.

FIELD OF THE INVENTION

The present invention relates to electrical cables and, more particularly to the construction of electrical interconnection cables that accurately transmit electrical impulses. The improved structures include new geometries and architectures for combining conductors and for shielding.

BACKGROUND OF THE PRESENT INVENTION

The sophistication and overall quality of audio cables has progressed rapidly over the past several years and now stands as a dominant specialty of serious audio technology. A perfect audio interconnection cable has, in one sense, become the holy grail of the high end audio field. As other audio components such as amplifiers, preamplifiers, CD players, speakers, etc. have rapidly evolved, they have continued to be interconnected by cables with similar, and in some cases identical, geometries to their 1940's era ancestors. Many entrepreneurs have leapt into the gulf in an attempt to both improve the quality of sound as well as to capitalize on this booming market.

Typically, an audio system consists of: an audio signal source (e.g., a turntable, FM tuner, CD player, microphone, tape deck, etc); an amplifier, either integrated or consisting of a separate pre-amplifier and power amplifier; and finally speaker (i.e., a loudspeaker) system. All these devices must be interconnected by suitable electrical cables, heretofore usually of different types depending on the nature of electrical signals to be carried. Even if the component interconnections are theoretically simple, experience shows that the interconnection cables may greatly influence the quality of the signal reproduced by the audio system. The interconnection cables are known to influence at least: the tone-color of the signal; the spatial reconstruction of the audio "image"; the amount of lost information; the focusing of the sound sources; the dynamic range; the audibility of the sound event; the naturalness of the reproduced sound, and the noise level introduced into the audio signal. These, as well as other variations and distortions imposed on an audio signal by an interconnect cables are all degradations of the reproduced signal with respect to the original event.

Although the impact of an audio interconnection cables on the overall quality of an audio system has been recognized since the inception of electronic high-fidelity equipment, the development of specialized audio cable for serious high-fidelity applications begin in the 1970's. Pioneered by Robert Fulton, early audiophile cables improved sound quality by focusing primarily on the materials used in the cable. The use of copper as a conductor as well as the use of stranded conductors are examples of such developments. Concentric conductor (i.e., coaxial) cables have long been used for transmission of audio signals. Coaxial cables that include dielectric washers made of rubber or glass between the concentric conductors have been proposed, for example, as disclosed in U.S. Pat. No. 1,818,027 issued to Affel, et al. Helical polymer spacers have been used between olefin polymers to separate conductive layers as taught in U.S. Pat. No. 3,309,455 to Mildner. Fulton was one of the first to address the issue of frequency dependent signal timing by developing cable of specific lengths. Signal timing considerations were further addressed by Brisson (U.S. Pat. No. 4,538,023) and Magnan (U.S. Pat. No. 4,767,890). Different sized conductors within a single cable have also been proposed as in U.S. Pat. No. 4,628,151 to Cardas.

The aforementioned, as well as other specialized cables have made progress towards an optimum cable that, theoretically, introduces no degradation into an audio or other signal being conducted by the cable. Heretofore, however, these attempts have meet with only limited success. While some cables of the prior art have overcome a few of the known problems, they have not yet reached a point of becoming "acoustically invisible". The present invention, however, provides cables which move considerably closer to acoustic invisibility than any cable of the prior art. While prior art cables have been constructed differently depending upon their function (i.e., their placement in the overall audio signal path), the cables of the present invention use identical geometries regardless of their function. For example, the same cable geometry may be used for a cable from a moving coil phono cartridge carrying a signal in the low millivolt range as for a power cable carrying several amps of line current to a power amplifier. The same cable geometry is used regardless of whether the carried signal is analog or digital, audio or video, or even AC power. It has even been hypothesized that a high-voltage automobile ignition cable might benefit from a construction in accordance with the present invention.

Evaluating an audio cable's performance is not an easy task. Fortunately, the human ear is a remarkable, wide-range transducer whose dynamic range is estimated to be on the order of 140 dB. This is a far greater dynamic range than is often obtainable in typical electronic circuits and test equipment. Because the ear is so sensitive that small, often otherwise unmeasurable, changes or distortions in an audio signal are audible to and detectable by a discerning ear. There is an old adage, if something sounds good, it will measure "good". However, not everything that measures "good" will sound good. Because, at least for audio interconnection cables, the ultimate "consumer" is the human ear, such ears have been enlisted to evaluate the cables of both the prior art and the present invention. Two cables may both measure well using conventional, generally accepted standards of impedance, capacitance, inductance, noise, etc. However, those two cables with seemingly identical measured electrical characteristics may not sound the same to the trained ear, for example, when listening to music.

DISCUSSION OF THE RELATED ART

Many attempts at improving the performance of audio cable appear in the prior art. For example, U.S. Pat. No. 4,628,151 for MULTI-STRAND CONDUCTOR CABLE HAVING ITS STRANDS ARRANGED ACCORDING TO THE GOLDEN SECTION, issued Dec. 9, 1986 to George F. Cardas teaches a cable system in which the ratio of sizes of individual conductor strands vary compared to one another by a ratio of approximately 0.62.

U.S. Pat. No. 4,767,890 for HIGH FIDELITY AUDIO CABLE, issued Aug. 30, 1988 to David L, Magnan teaches a cable construction wherein a ring of small conductors is arranged about the perimeter of a large diameter core. Spacers are used to support an outer shield at a predetermined distance away from the ring of small diameter "all skin" conductors.

U.S. Pat. No. 4,945,189 for ASYMMETRIC AUDIO CABLE FOR HIGH FIDELITY SIGNALS, issued Jul. 31, 1990 to Donald E. Palmer discloses an electrical conductor formed by two insulated strands, the second being wound helically around a substantially straight first conductor.

U.S. Pat. No. 4,980,517 for MULTI-STRAND ELECTRICAL CABLE, issued Dec. 25, 1990 also to George F. Cardas, discloses conductors wherein individual conductors of different sizes are arranged in particular geometries.

U.S. Pat. No. 5,064,966 for MULTIPLE SEGMENT AUDIO CABLE FOR HIGH FIDELITY SIGNALS, issued Nov. 12, 1991 to Donald E. Palmer discloses an electrical conductor formed from two insulated strands twisted together. However, one of the two strands is cut at a predetermined point to form a discontinuity therein.

U.S. Pat. No. 5,109,140 for HIGH FIDELITY AUDIO CABLE, issued Apr. 28, 1992 to Kha D. Nguyen teaches insulated conductors spaced-apart from one another and wrapped with a ferromagnetic foil.

U.S. Pat. No. 5,110,999 for AUDIOPHILE CABLE TRANSFERRING POWER SUBSTANTIALLY FREE FROM PHASE DELAYS, issued May 5, 1992 to Todd Barbera teaches geometry for a power cable wherein each of three conductors has multiple stands of different gauge cables twisted together.

U.S. Pat. No. 5,266,744 for LOW INDUCTANCE TRANSMISSION CABLE FOR LOW FREQUENCIES, issued Nov. 30, 1993 to Dwight L. Fitzmaurice, discloses substantially parallel coaxial transmission lines in close proximity to one another.

U.S. Pat. No. 5,376,758 for STABILIZED FLEXIBLE SPEAKER CABLE WITH DIVIDED CONDUCTORS, issued Dec. 27, 1994 to Ray L. Kimber teaches a set of speaker cables braided about an enlarged, flexible core to minimize electromagnetic field interactions between the conductors.

U.S. Pat. No. 6,005,193 for CABLE FOR TRANSMITTING ELECTRICAL IMPULSES, issued Dec. 21, 1999 to Mark L. Markel teaches another cable geometry wherein the conductors are substantially flat and arranged in a predetermined relationship to one another.

U.S. Pat. No. 6,066,799 for TWISTED-PAIR CABLE ASSEMBLE, issued May 23, 2000 to Steven Floyd Nugent, teaches a twisted-pair configuration wherein over one half of the twisted pair run, a second conductor of the twisted pair is insulated and uninsulated over the remainder of the run.

U.S. Pat. No. 6,388,188 for ELECTRICAL CABLE AND METHOD OF MANUFACTURING THE SAME, issued May 14, 2002 to Ian Harrison teaches a twisted cable configuration having two electrically conductive members and a third, electrically non-conductive member twisted together to control the geometrical relationship of the two electrically conductive members in relation to one another other.

U.S. Pat. No. 6,570,087 for DELTA MAGNETIC DEFLUXING FOR LOW NOISE SIGNAL CABLES, issued May 27, 2003 to David Navone et al. teaches a specialized geometry for cables for conducting electrical signals in proximity to strong sources of electromagnetic interference.

U.S. Pat. No. 6,658,119 for AUDIO SIGNAL CABLE WITH PASSIVE NETWORK, issued Dec. 2, 2003 to Bruce A. Brisson et al. teaches a passive RC or RLC network imposed between a signal line and a ground line in or at a terminus of an audio cable.

None of these patents, taken alone or in combination, is seen to teach or suggest the novel cable constructions of the present invention.

SUMMARY OF THE INVENTION

In accordance with the present invention there is provided a novel cable architecture for construction of audio interconnection, video, digital, or power cables. Multiple, parallel runs of multiconductor, shielded, twisted pair cable are used to construct balanced and unbalanced low-level interconnect cables, speaker cables, and power cords. Conductors from each cable run are separated and connected to other conductors from other runs of the cable to form composite signal and ground conductors. Shields of each cable run are selectively connected to one another and to appropriate pins or terminals of a terminating connector. An overall mother shield may, optionally, be added. Individual runs of cable are braided together. Cables constructed in accordance with the novel geometries and techniques of the invention sound better than any know cable of the prior art. When measured, the inventive cables exhibit a ratio of capacitance to inductance that is lower that any known audio cable of the prior art. The characteristic impedance of the inventive cables is also lower than other cables of the prior art.

It is, therefore, an object of the invention to provide an improved cable assembly for conducting electrical signals.

It is another object of the invention to provide an improved cable assembly wherein multiple, independent, parallel cable runs are used to conduct an electrical signal.

It is a further object of the invention to provide an improved cable assembly wherein each independent parallel cable run is shielded.

It is an additional object of the invention to provide an improved cable assembly wherein shields of individual cable runs are grounded at only one, or at both ends of the cable assembly.

It is yet another object of the invention to provide an improved cable assembly wherein shield of individual cables runs are selectively connected one to another at either one or both ends of the cable assembly.

It is a still further object of the invention to provide an improved cable assembly in both balanced and unbalanced configurations.

It is an additional object of the invention to provide an improved cable assembly useful for use in audio systems for component interconnect cables, speaker cables, and power cables.

It is another object of the invention to provide an improved cable assembly which exhibits a very low characteristic impedance.

It is still further object of the invention to provide an improved cable assembly having a consistent transient response across varying source and load impedances.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Unbalanced audio cables traditionally have consisted of a single conductor, solid or, more often, stranded, surrounded by an insulating dielectric, typically polyethylene or a similar polymer. A conductive shield, typically woven metal or foil is then wrapped around the dielectric. Finally, an insulating jacket is placed over the shield. This forms a two conductor cable used for transmitting an unbalanced signal. A typical unbalanced cable of the prior art is shown schematically in FIG. 11. The disadvantages of unbalanced signal transmission are well known to those skilled in the electrical engineering and communications arts.

To overcome these disadvantages, balanced signal topologies have long been used. To create a simple cable useful for transmitting a balanced signal, the single, central conductor is replaced by a twisted pair of conductors surrounded by a shield and jacket. The advantages of twisted-pair cables are also well known, primarily their ability to reduce common mode interference (i.e., noise) induced in the cable from external sources.

As discussed hereinabove, cables for use in conducting audio and other signals have received considerable attention in an attempt to achieve better and better performance. While much attention has been paid to the internal arrangement of the conductors, the dielectric material surrounding the conductors, the conductor materials and sizes, and in some cases, other electrical components in the signal path, prior art cables are most often assembled to look like one of the two alternatives shown schematically in FIGS. 1*a* and 1*b*.

Figure 1A:
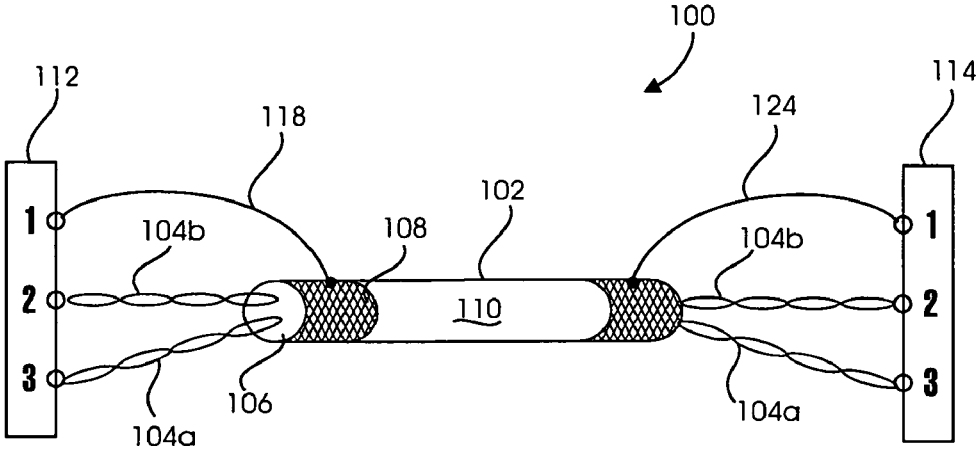
Prior Art Figure 1a
FIGS. 1*a* and 1*b* are schematic representations of two embodiments of prior art cables for conveying balanced electrical signals.

Referring first to FIG. 1*a*, there is shown a schematic representation of a cable assembly of the prior art suitable for use in conducting balanced signals between two electrical devices, generally at reference numbers 100. A cable 102 has two twisted pairs 104*a*, 104*b* of insulated electrical conductors surrounded by a dielectric (i.e., insulation) 106 which is, in turn surrounded by a shield 108 and ultimately, a jacket 110. Both conductors, not individually identified, of each twisted pair 104*a*, 104*b* are shown electrically connected to pins 3 and 2, respectively, of a connector 112. Shield 106 is electrically connected to pin 1 of connector 112 by jumper 118.

A typical connector 112 is an "XLR" type connector well known to those skilled in the audio arts. It will be recognized that may types of connectors as well as other ways of terminating electrical cables are know to those of skill in the art and that any suitable means for connecting one or both ends of a cable to an electrical device may be interchangeably used as is appropriate. Therefore, the invention is not considered limited to any particular connector or other termination device. Pin 1 of XLR-type connectors is typically used as the common or ground connection while pins 2 and 3 form plus and minus connections for the balanced electrical signals. It will be recognized that pin designations may be arbitrary and other arrangements many be used as long as the pin designations are consistently applied.

A second connector 114 is shown attached to a distal end of cable 102. Twisted pairs 104*a*, 104*b* are attached to pins 3 and 2, respectively, of connector 114. Shield 108 is electrically connected to pin 1 of connector 110 by jumper 124. In the embodiment of cable 1 shown in FIG. 1*a*, shield 108 is connected to pin 1 of both connectors 112, 114.

Figure 1B:
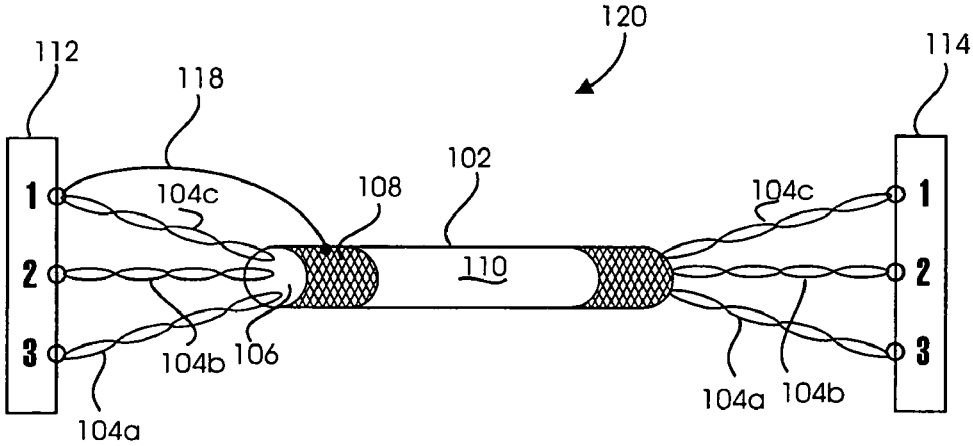
Prior Art Figure 1b

Referring now also to FIG. 1*b*, there is shown a schematic representation of a second embodiment of a cable assembly 120 of the prior art. In cable assembly 120, a third twisted pair 104*c* has been added to cable 102. Twisted pair 104*c* is connected to pin 1 of both connectors 112, 114. In addition, shield 108 is connected to pin 1 of connector 112 by jumper 118. Note, however, that shield 108 is not connected to pin 1 of connector 114.

The cable constructions of FIGS. 1*a* and 1*b*, or variations thereof, have been used for generations. Cable designers have heretofore gone to great lengths to control various parameters of a particular conductor (i.e., wire) within a cable. Designers have, for example, varied the conductor size (i.e., varied the AWG number), changed the number of strands within a conductor, changed the material (e.g., oxygen-free copper), created conductors from multiple strand sizes, and arranged conductor strands in particular geometries (e.g., golden ratio), and the like within a single conductor. Multiple conductors have also been arranged in many configurations with respect to each other. While some of these techniques have indeed produced audio cables with superior performance to their predecessors (i.e., an off-the-shelf, low-end cable of the prior art not incorporating any of the aforementioned enhancements), the cables built in accordance with the present invention perform significantly better than any known prior art cable.

In the context of the instant invention, improved performance is defined as providing an audibly discernable, positive difference to a listener in a blind listening test when a cable in accordance with the invention is substituted for a cable of the prior art. As was discussed hereinabove, the human ear is an extraordinary instrument able to discern differences unmeasurable by all but the finest laboratory test equipment. The adage that says a cable that sounds "good" will measure "good" but not every cable that measures "good" will sound good has been found valid by the inventors as the inventive cable geometries were evaluated. Measurements were made on cables built in accordance with the present invention and the results of these measurements are discussed hereinbelow.

Figure 2:
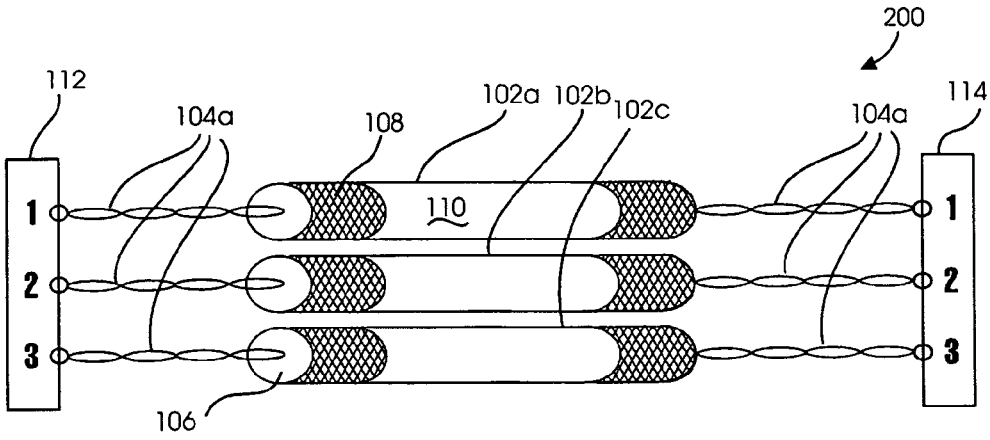
FIG. 2 is a schematic representation of a first embodiment of a cable assembly for conveying balanced electrical signals in accordance with the present invention.

Referring now to FIG. 2, there is shown a schematic representation of a first embodiment of cable assembly having a geometry providing improved performance over the cables of the prior art, generally at reference number 200. Three discrete cables 102*a*, 102*b*, 102*c*, each having a single twisted pair of insulated conductors 104*a* surrounded by a dielectric 106, a shield 108, and a jacket 110 are connected, respectively to pins 1, 2, and 3 of connectors 112 and 114. Cables 102*a*, 102*b*, 102*c* were braided together (i.e., mutually twisted around one another) [Joe/Howard—lets come up with a scientific description of the braiding process, if possible, for insertion here] No connection is made between shield 108 of any of the cables 102*a*, 102*b*, 102*c* to any pin of either connector 112 or 114. This is hereinafter referred to as cable configuration one. Listening tests conducted on cables made in accordance with configuration one yielded surprisingly improved performance compared to cables constructed in accordance with the prior art geometries of FIGS. 1*a* and 1*b*, hereinafter, prior art cables.

Figure 3:
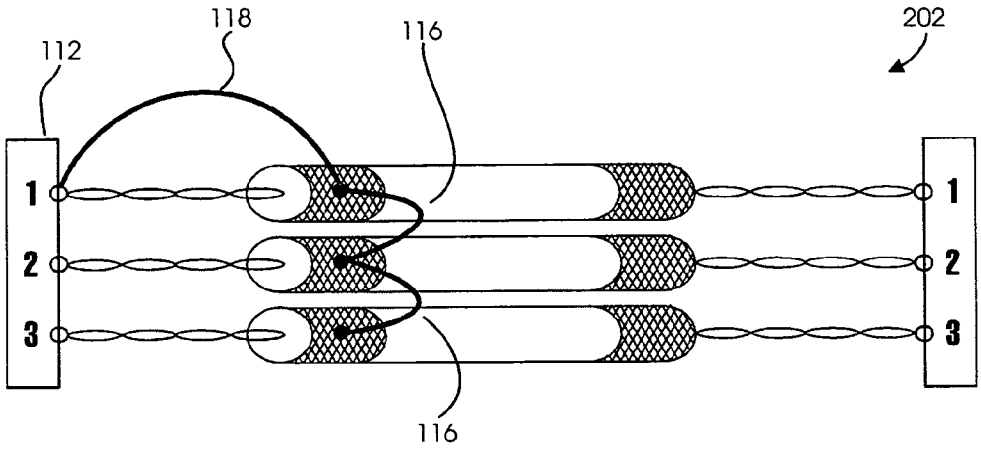
FIG. 3 is a schematic representation of a the cable of FIG. 2 showing shields connected at only a first end thereof.

Referring now also to FIG. 3, there is shown a second cable configuration 202, identical to the configuration 200 of FIG. 2 except that shields 108 of cables 102*a*, 102*b*, 102*c* are connected one to another, schematically by jumpers 116. In addition, the interconnected shields 108 are commonly connected to pin 1 of connector 112 by jumper 118. As was the case with the cables assembly of FIG. 2, cables 102*a*, 102*b*, and 102*c* are braided together as described hereinabove. Cables built in accordance with this second configuration provided superior performance to both prior art cables as well as to configuration one cables of the present invention. Subjectively, listeners report improvements in such terms as: "the noise level was easily discernable as better (lower) with increased air, ambience, and top end delicacy, as well as deeper, firmer bass."

Figure 4:
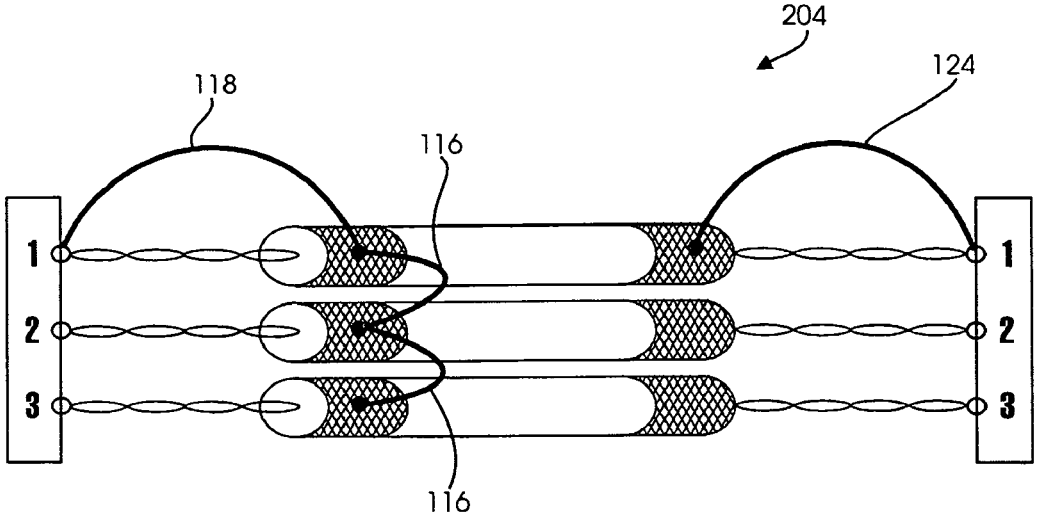
FIG. 4 is a schematic representation of the cable of FIG. 3 showing shields connected at a first end, and a first embodiment of shield connection arrangement at a second end thereof.

Referring now also to FIG. 4, there is shown yet another cable assembly 204, identical to cable assembly 202 of FIG. 3 except that the shield 108 of only cable 102*a* is connected to pin 1 of connector 114 at the distal end of the cable assembly by jumper 124. Again, there is a performance improvement between cables constructed in accordance with this third configuration and prior art, configuration one, and configuration two cables.

Figure 5:
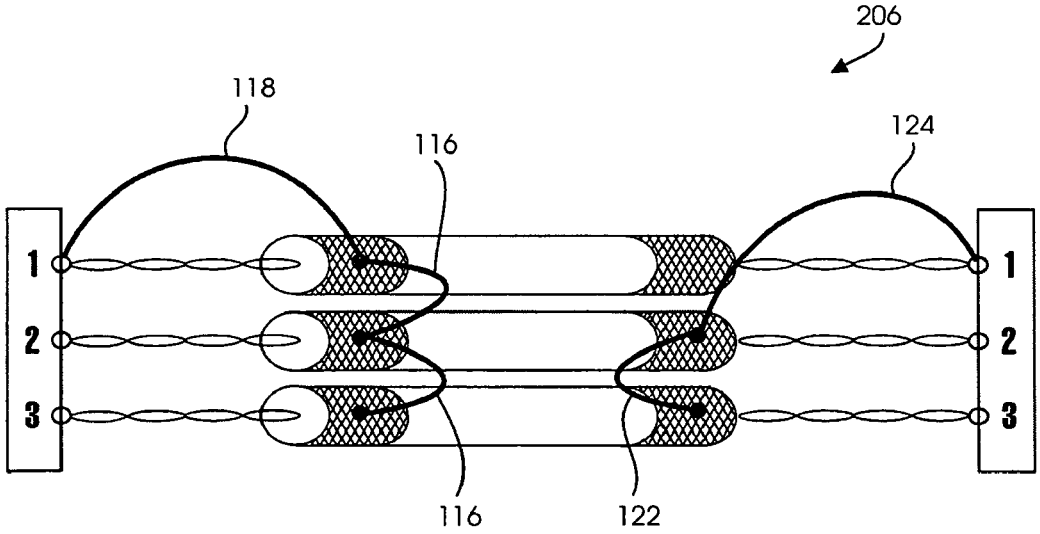
FIG. 5 is a schematic representation of the cable of FIG. 3 showing shields connected at a first end, and a second embodiment of shield connection arrangement at a second end thereof.

Referring now also to FIG. 5, there is shown yet another cable assembly geometry, generally at reference number 206, also identical to cable assembly 202 of FIG. 3 with the exception that now shields 108 of cables 202*b* and 202*c* are connected one to the other by jumper 122 and both shields are connected to pin 1 of connector 114 by jumper 124. Yet again, performance improvement is achieved compared to prior art cables, and cable assemblies 200, 202 and 204 of FIGS. 2, 3, and 4, respectively.

Figure 6:
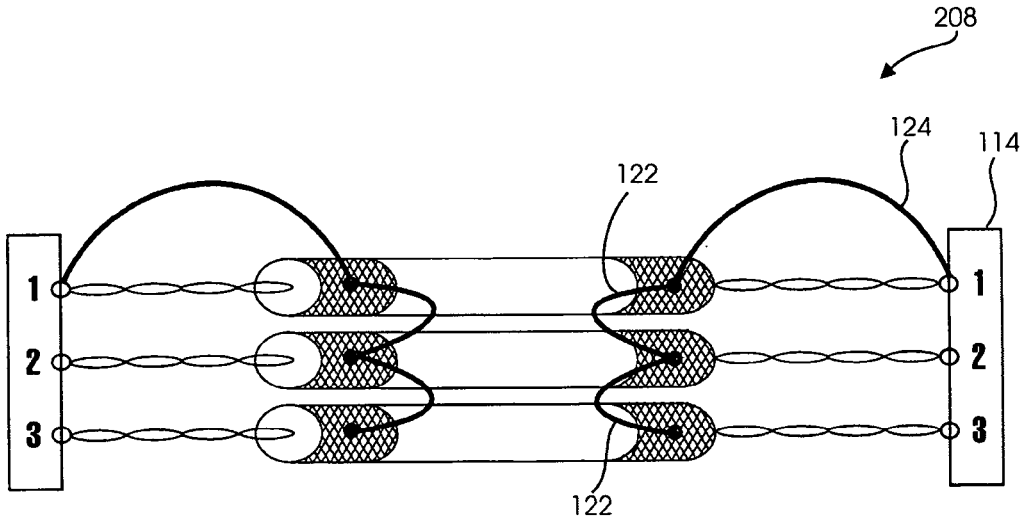
FIG. 6 is a schematic representation of the cable of FIG. 3 showing shields connected at a first end, and a third embodiment of shield connection arrangement at a second end thereof.

Referring now also to FIG. 6, there is shown another cable assemble 208, also identical to cable assembly 202 of FIG. 3, with the exception that now the shields 108 of all three cables 102*a*, 102*b*, and 102*c* are connected one to another by jumpers 122 and all three connected shields 108 are connected to pin 1 of connector 114 by jumper 124. This combination seemed to add distortion in the form of ringing to the sound and was therefore not further pursued.

Figure 7:
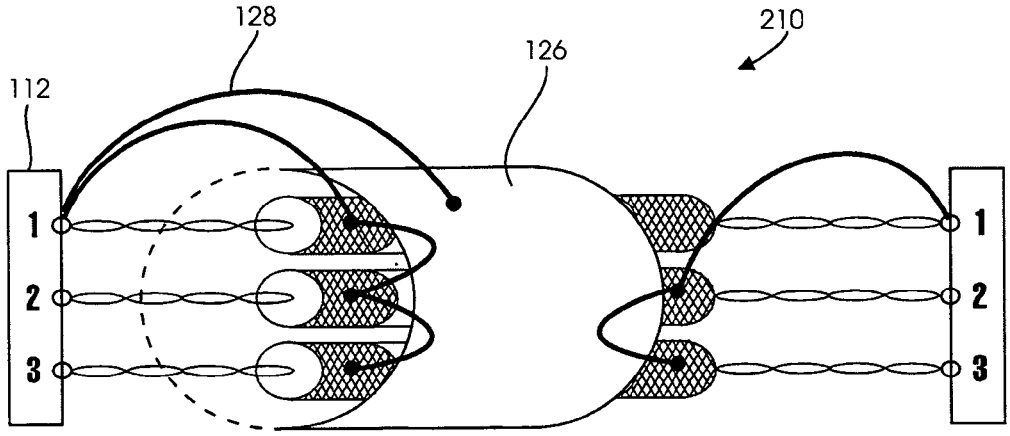
FIG. 7 is a schematic representation of the cable of FIG. 5 showing an added overall mother shield.

Referring now also to FIG. 7, there is shown a cable assembly 210 which is substantially identical to cable assembly 206 (FIG. 5) except that a mother shield 126 is placed completely around the cable bundle of braided cables 102*a*, 102*b*, and 102*c*. Mother shield 126 is connected to pin 1 of connector 112 by jumper 128. Mother shield 126 is typically a braided shield sleeve that may be placed over the bindle of braided cables 102*a*, 102*b*, and 102*c*. However, it will be recognized that any other shielding device or technique such wrapped foil, stretched perforated metal, shielded zipper tubing, or any other shielding material or technique may be used and the invention is not considered limited to any specific shielding device or technique.

The addition of mother shield 126 again yields improved performance compared to the prior art cables as well as cable assemblies 200, 202, 204, and 206. Subjectively speaking, listeners report: "low frequency (i.e., bass) extension and tautness, lowered noise levels, improved high frequency extension and delicacy, improved ambient information, and very high levels of resolution." A cable constructed in accordance with FIG. 7 provides audible performance better than any audio cable of the prior art available for listener comparison.

Having seemingly exhausted performance enhancements available through shielding/grounding manipulations, the inventors turned their attention to what other manipulations could be performed to further improve cable performance.

Figure 8:
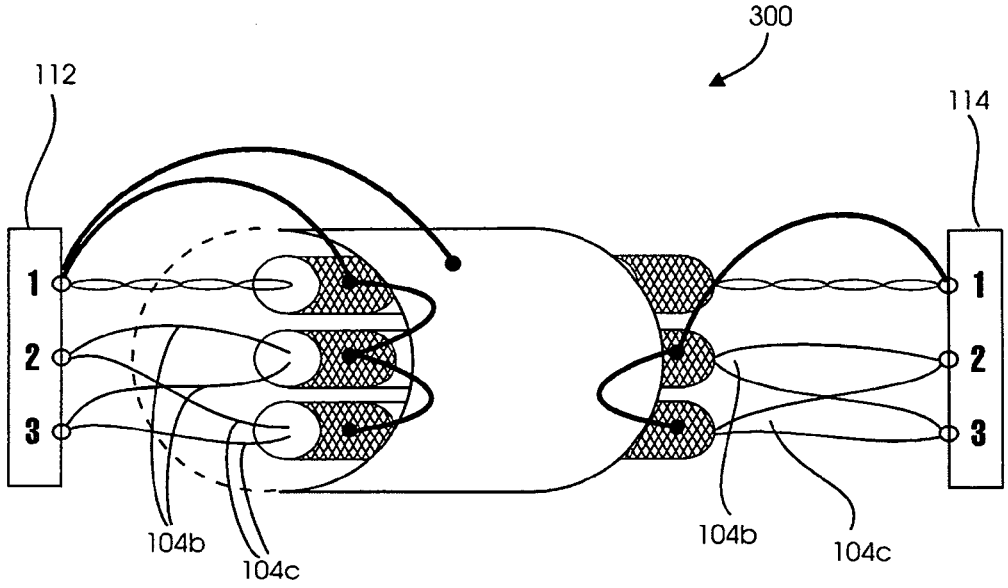
FIG. 8 is a schematic representation of a second embodiment of a cable assembly in accordance with the invention wherein conductors within some individual cables runs are split.

Referring now also to FIG. 8, there is shown a cable assembly 300, similar to cable assembly 210 of FIG. 7. Twisted pairs 104*b* and 104*c* of cables 102*b* and 102*c*, respectively are separated (i.e., divided) such that one conductor of each twisted pair 104*b*, 104*c* is connected to pin 2 of both connectors 112, 114 while the remaining conductors of twisted pairs 104*b* and 104*c* are connected to pin 3 of both connectors 112, 114. It will be noted that both conductors of twisted pair 104*a* of cable 102*a* remain connected to pin 1 of both connectors 112 and 114. Still further performance enhancements are noted with cable assembly 300 compared to cable assembly 210 of FIG. 7, heretofore the best performing cable.

With all shields 108 tied together (i.e., commoned) at the connector 112 end of cable assembly 300, and with the addition of mother shield 126, the inventors suspected that there was enough "gauge" (i.e., enough current carrying capacity) to release the conductors of cable 102*a* (i.e., twisted pair 102*a*) from service in interconnecting pins 1 of connectors 112 and 114. One conductor of twisted pair 104*a* was, therefore, connected to pin 2 of both connector 112, 114 and the remaining conductor of twisted pair 104*a* was likewise connected to pin 3 of both connectors 112 and 114. This cable assembly 302 is shown schematically in FIG. 9. The performance enhancement provided by this configuration was astonishing, an extremely significant improvement in audible performance. The improved performance of cable assembly 302 is not completely understood. It is believed that several factors may be involved. First, the addition of the conductors of twisted pair 102*a* in parallel with the conductors of twisted pairs 102*b* and 102*c* in interconnecting pins 2 and 3 of connectors 112 and 114 is believed to play a role. The separations of the individual conductors interconnecting a particular pin of connectors 112 and 114 is also believed to be significant. Mutual induction is thereby reduced.

Figure 9:
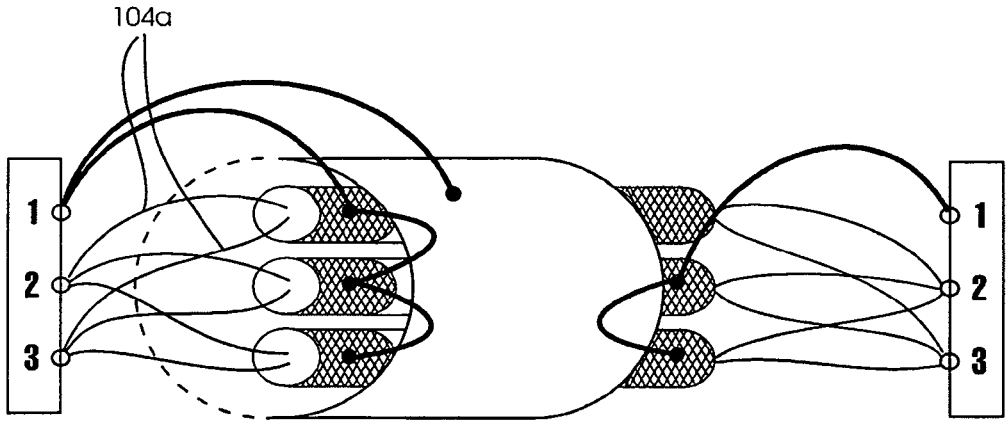
FIG. 9 is a schematic representation of a third embodiment of a cable assembly in accordance with the invention wherein conductors within all individual cables runs are split.
Figure 10A:
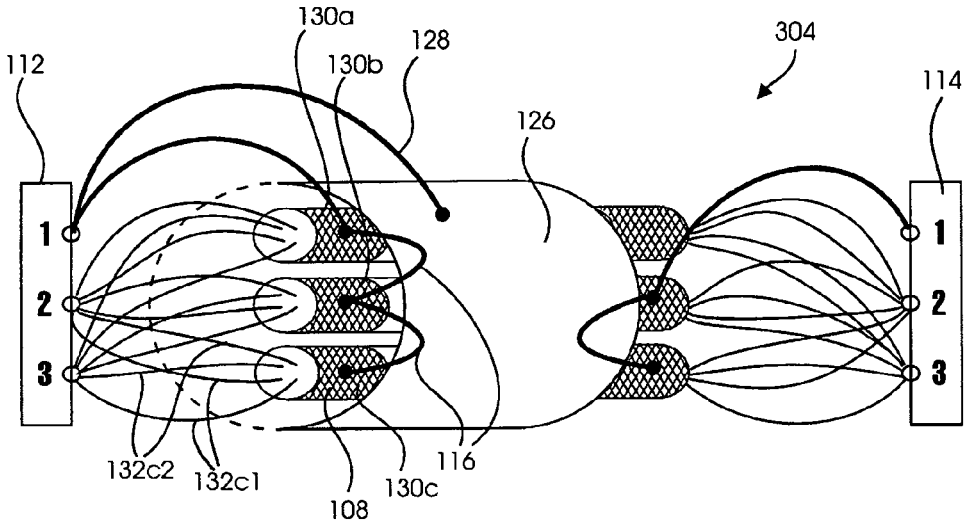
FIG. 10*a* is a schematic representation of a fourth embodiment of a cable assembly in accordance with the invention wherein individual cables are four conductor twisted pair cables.
Figure 10B:
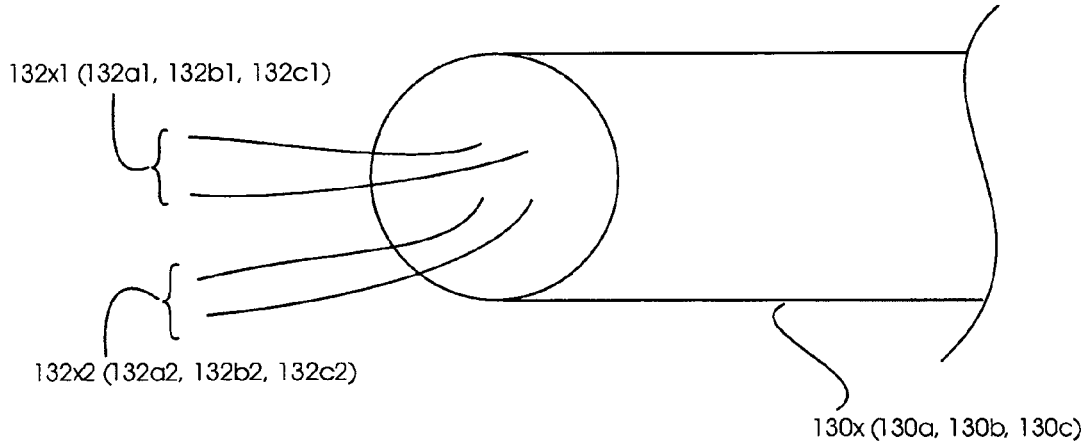
FIG. 10*b* is a simplified schematic representation of the cable of FIG. 10*a;*

Referring now also to FIGS. 10*a* and 10*b*, the concept of cable 302 of FIG. 9 is extended. In cable assembly 204 (FIG. 4), individual cables 102*a*, 102*b*, and 102*c* (FIG. 9) are single twisted pair cables. These are replaced by cables 130*a*, 130*b*, and 130*c* which each contain two twisted pairs of conductors designated 132*a*1, 132*a*2, 132*b*1, 132*b*2, 132*c*1, and 132*c*2, respectively. For clarity, only individual twisted pairs 132*c*1, 132*c*2 are individually labeled in FIG. 10*a*. Rather, FIG. 10*b* provides a schematic end view of a generic cable (130*x*) representing any one of cables 130*a*, 130*b*, or 130*c* showing the designations 132*x*1 and 132*x*2 representing respective twisted pairs 132*a*1, 132*a*2, 132*b*1, 132*b*2, 132*c*1, and 132*c*2.

One conductor of each twisted pair 132*a*1, 132*a*2, 132*b*1, 132*b*2, 132*c*1, 132*c*2 is shown connected to pin 2 of connectors 112 and 114. The other conductor of each twisted pair 132*a*1, 132*a*2, 132*b*1, 132*b*2, 132*c*1, 132*c*2 is, likewise, connected to pin 3 of both connectors 112, 114. The performance of cable assembly 304 exceeds all previous cables. It will be recognized that that the concept of splitting a signal between multiple conductors in multiple cables may be extended to more than three individual cables 130 and/or more than two twisted pairs per cable. Consequently, the inventive concept is not considered limited to any specific number of individual cables or to any particular configuration of conductors within the individual cables. Cable assembly 304 is the best performing of any of the cable configurations in both listening and objective electrical tests as discussed in more detail hereinbelow. It has been designated the "ultimate" configuration.

Figure 26:
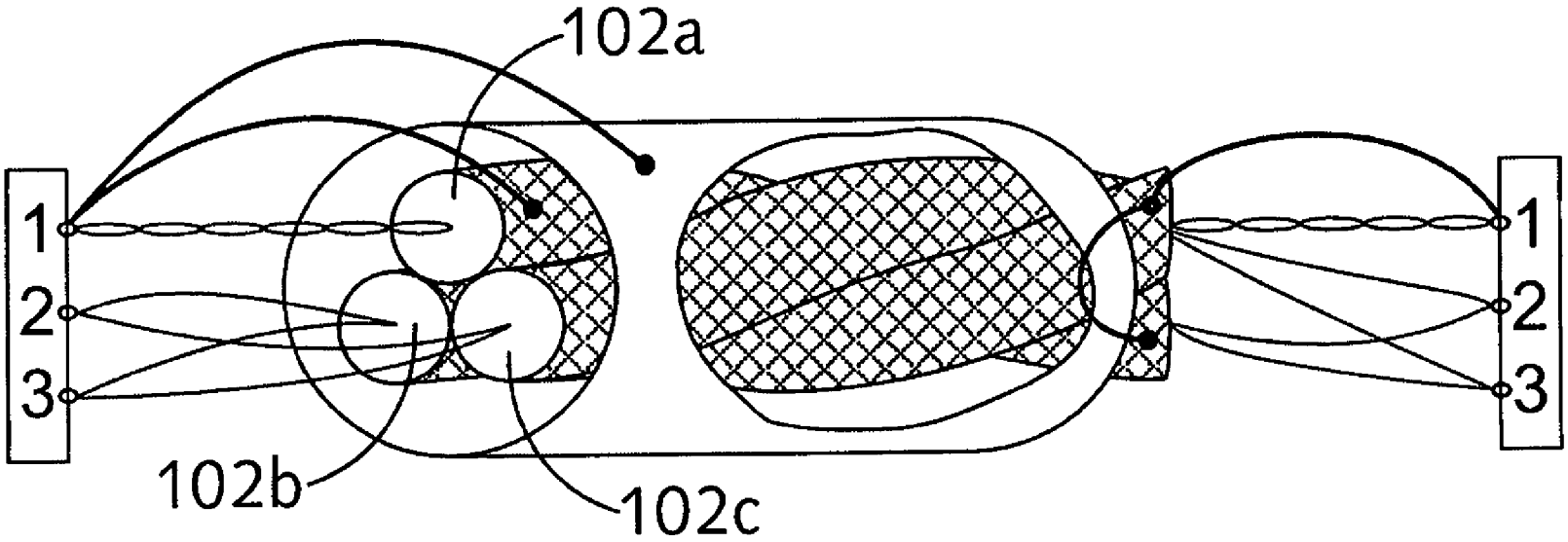
FIG. 26 is a schematic representation of the cable assembly of FIG. 9 wherein individual cables are twisted or braided together.

Referring now also to FIG. 26, there is shown a schematic representation of the cable assembly of FIG. 9 wherein individual conductors 102*a*, 102*b*, 102*c* are twisted or braided together. Such twisted or braided configurations are believed to be known to those of skill in the art and are not further described herein. The concept illustrated in FIG. 26 may be applied to any of the disclosed cable assembly configurations, for example, cable assembly 304 (FIG. 10*a*)

Figure 11:
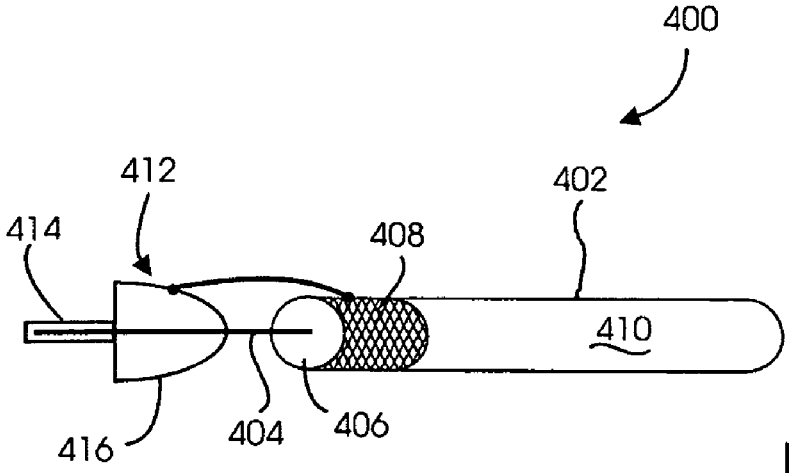
Prior Art Figure 11
FIG. 11 is a schematic representation of one end of a typical unbalanced audio cable of the prior art.

The performance improvements created in balanced audio cables may also be realized in unbalanced audio cables by applying the innovative techniques of the present invention. Such unbalanced audio cables of the prior art are exemplified by the cable assembly 400 illustrated schematically in FIG. 11. FIG. 11 illustrates only one end of a cable. It will be recognized that an appropriate connection, not shown, must be supplied at the distal end of cable 402. A coaxial cable 402 has a center conductor 404 surrounded by a dielectric 406, a shield 408, and a jacket 410. Cable 402 is terminated in a connector 412 wherein a center pin 414 is connected to conductor 404 and a shell 416 is connected to shield 408. Several types of connectors are commonly used with unbalanced cable configurations, the most popular being the well-known RCA pin plug and the ¼ inch phone plug. Several miniature versions of phone plug style connectors are also well known and widely used. Many variations of center conductor 404 (e.g., solid, stranded, twisted pair, etc.) as well as dielectric 406 are also well known and widely used.

Figure 12A:
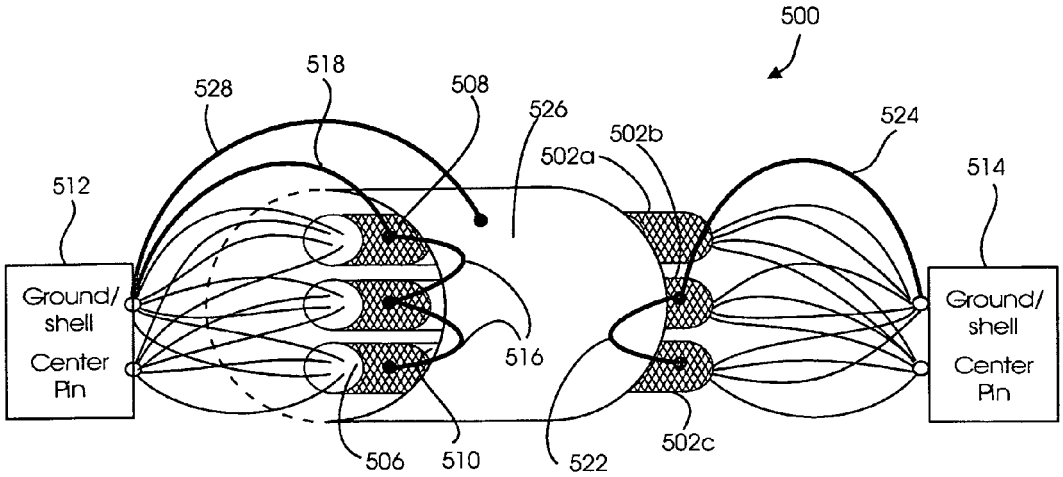
FIG. 12*a* is a schematic representation of an unbalanced cable assembly in accordance with the present invention.
Figure 12B:
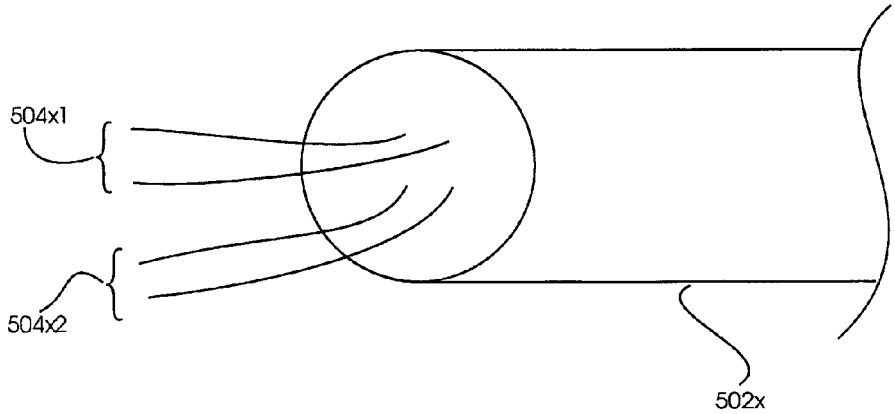
FIG. 12*b* is a schematic view of an end of an individual cable run of the cable assembly of FIG. 12*a;*

Referring now to FIG. 12*a*, there is shown an unbalanced cable assembly implementing the concepts of the present invention, generally at reference number 500. It will be recognized that cable assembly 500 is similar to cable assembly 304 (FIG. 10) except that twisted pairs 504*x* (FIG. 12*b*) are distributed only between the center pin and the shell of a connectors 512 and 514. Individual cables 520*a*, 502*b*, and 502*c*, each have two twisted pairs 504*a*1, 504*a*2, 504*b*1, 504*b*2, 504*c*1, and 504*c*2, which, for clarity, are not individually identified in FIG. 12*a*. Rather, FIG. 12*b* shows the arrangement of a representative, generic twisted pairs 504*x*1, 504*x*2, for each of the cables 502*a*, 502*b*, and 502*c*. Each cable 502*a*, 502*b*, and 502*c* has two twisted pairs 504*a*1, 504*a*2, 504*b*1, 504*b*2, 504*c*1, and 504*c*2, surrounded by dielectric 506, shield 508, and finally, jacket 510. One conductor of each of twisted pairs 504*a*1, 504*a*2, 504*b*1, 504*b*2, 504*c*1, and 504*c*2 are connected to a center pin of both connectors 512 and 514. The other conductor of each of twisted pairs 504*a*1, 504*a*2, 504*b*1, 504*b*2, 504*c*1, and 504*c*2 are connected to the shell or ground of connector 512 and 514. Shields 508 of cables 502*a*, 502*b*, and 502*c* are electrically connected to one another by jumpers 516, and to the shell connection of connector 512 by jumper 528. Likewise, shields 508 of cables 502*b* and 502*c* are electrically connected to each other by jumper 522 and to the shell of connector 514 by jumper 524. A mother shield 526 surrounds cables 502*a*, 502*b*, and 502*c* which are braided together. Mother shield 526 is connected to the shell of connector 512 by jumper 528. While shields 508 of cables 502*b* and 502*c* are shown interconnected in cable assembly 500, alternatively, any two of the three shields 508 of cables 502*a*, 502*b*, and 502*c* may be interconnected at the connector 514 end of cable assembly 500 to achieve similar cable performance.

It will be recognized that while only the "ultimate" configuration of an unbalanced audio cable 500 has been illustrated, any of the intermediate cable assemblies shown in FIGS. 2 through 9 could readily be adapted for use as unbalanced cables.

Another area in the audio field where improving cable performance has been pursued is in making cables adapted for connecting loudspeakers to the outputs of audio power amplifiers. While such cables are typically two-conductor cables, unlike the unbalanced cables of FIGS. 11, 12*a* and 12*b*, speaker cables typically do not connected either conductor to ground and, in addition, are typically not shielded. However, it has been demonstrated that the techniques of the present invention applied to both balanced and unbalanced audio cables may also be successfully applied to speaker cables.

Figure 13A:
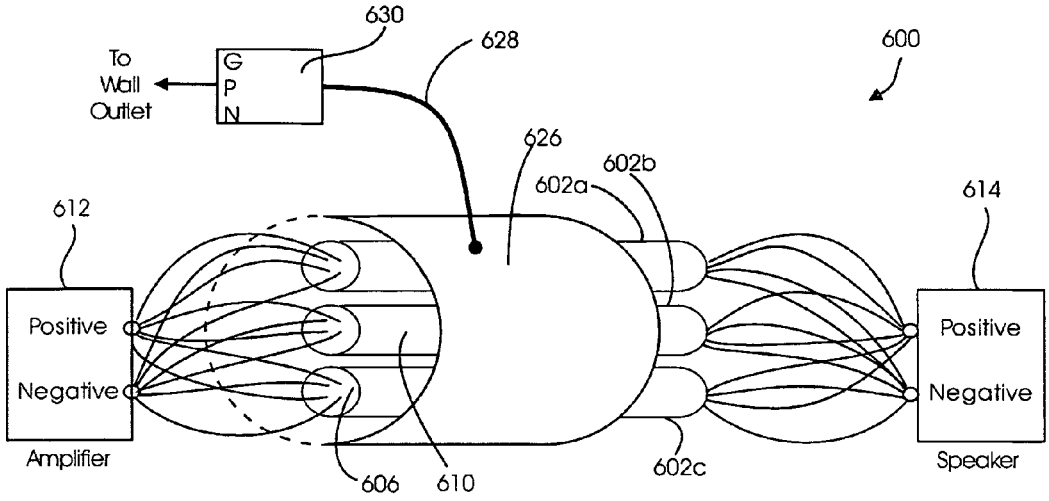
FIG. 13*a* is a schematic representation of a speaker cable in accordance with the invention.
Figure 13B:
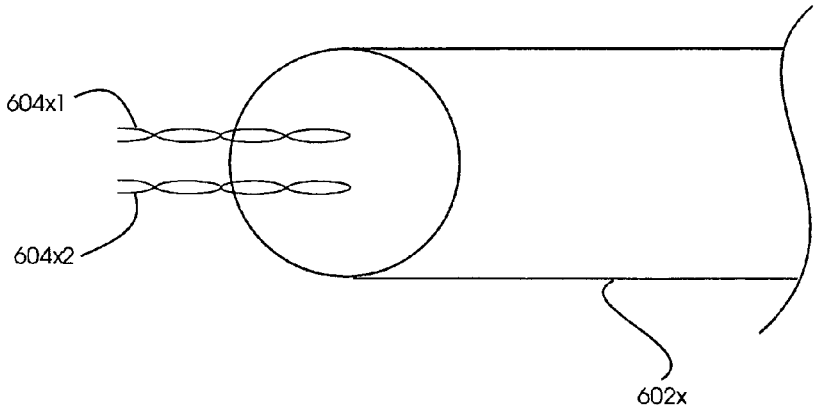
FIG. 13*b* is a schematic view of an end of an individual cable run of the cable assembly of FIG. 13*a;*

FIG. 13*a* shows such a speaker cable assembly, generally at reference number 600. The construction of cable assembly 600 is very similar to cable assembly 500 (FIG. 12) with the exception that discrete cables 602*a*, 602*b*, and 602*c* are unshielded. Each cable 602*a*, 602*b*, and 602*c* has two twisted pairs 604*a*1, 604*a*2, 604*b*1, 604*b*2, 604*c*1, and 604*c*1, not individually identified in FIG. 13*a*. FIG. 13*b* shows a representative one of cables 602*a*, 602*b*, and 602*c* identified as 602*x*. As with cable assemblies described hereinabove, cable assembly 600 connects one conductor from each twisted pair 604*a*1, 604*a*2, 604*b*1, 604*b*2, 604*c*1, and 604*c*1 to one of the positive or negative terminals at both the amplifier connector 612 or the speaker connector 614, the other conductor of each twisted pair 604*a*1, 604*a*2, 604*b*1, 604*b*2, 604*c*1, and 604*c*1 to the other terminal, also at both the amplifier connector 612 and the speaker connector 614. A mother shield 626 is placed around braided cables 602*a*, 602*b*, 602*c*. However, as neither the output connection 612 of the amplifier nor the speakers themselves have a true ground connection, another arrangement must be made. It is possible to ground the amplifier shield to the amplifier chassis. While this solution may work, the path to a true earth ground connection may be circuitous. A better solution may be to ground mother shield 626 to the electrical ground system of the building which is accessible through any electrical outlet carrying a "green wire" (i.e., earth) non-current carrying ground connection. Such a connection is not to be confused with the neutral (i.e., white wire) connection of standard electrical power service available at an obsolete two pin electrical outlet. An isolation network 630 connected to a power outlet, not shown, is connected to mother shield 626 by jumper 628. Isolation networks are well known to those skilled in the electrical engineering arts and need no further description. In yet other embodiments, jumper 628 may be connected to any another suitable earth ground.

Listening tests using speaker cable built in accordance with cable assembly 600 provided an improved listening experience when compared to any other speaker cable available for audition.

The audible and measured improvements noted in interconnect and speaker cables lead the inventors to further exploration of other cables in an audio system. The inventive concept was exported to power cables with little expectation of any improvement in sound from equipment using the enhanced cable. The sound, however, was improved when power cables in accordance with the techniques of the invention were substituted for standard power cables.

Figure 14:
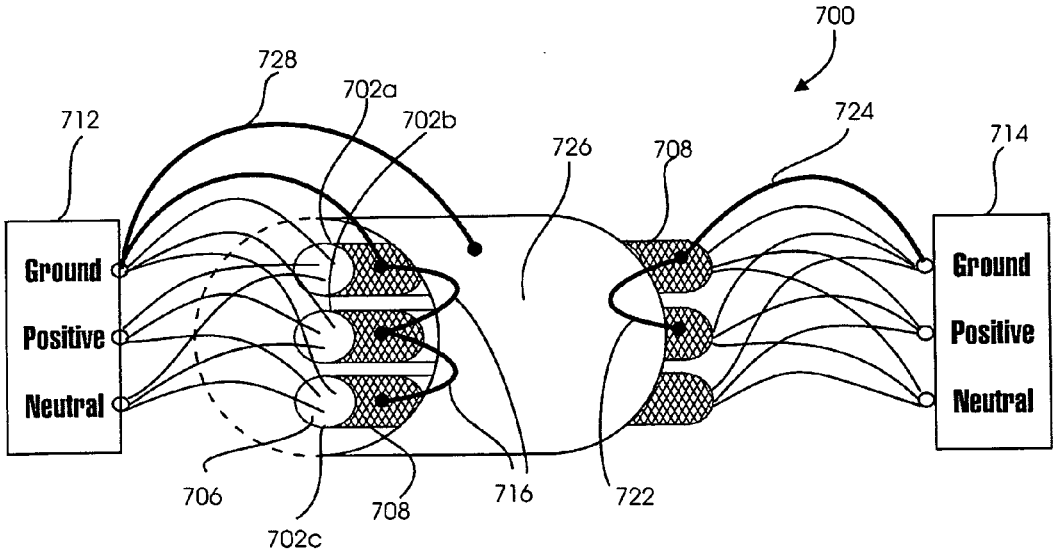
FIG. 14 is a schematic representation of an electrical power cord in accordance with the invention.

Referring now also to FIG. 14 there is shown a power cable 700 built in accordance with the inventive principles. Connector 712 represents a conventional duplex or similar outlet or other connection the AC power grid. Connector 714 is the connector adapted for connection to a piece of electrical equipment, not shown. Ground refers to the non-current carrying (i.e., green wire") ground, and positive to the "hot" conductor (typically the black conductor in a single-phase 117 volt system). It will be recognized that although a 117 volt, 60 Hz, AC, single-phase system typical of usage in the United States is chosen for purposes of disclosure, that the inventive techniques may be extended to other wiring topologies, voltages, frequencies, and phases and the invention is not considered limited to the embodiments chosen for purposes of disclosure.

Conductors 702*a*, 702*b*, and 702*c* are three conductor shielded cables, typically not twisted pair cables as used in other cable assemblies of the present invention. Cables 702*a*, 702*b*, and 702*c* each have a shield 708. Shields 708 of cables 702*a*, 702*b*, and 702*c* are electrically connected one to another at the connector 712 end by jumpers by jumpers 716, and to the ground connection of connector 712 by jumper 728. Likewise, shields 708 of cables 702*a* and 702*b* are electrically connected to each other by jumper 722 and to the ground connection of connector 714 by jumper 724. A mother shield 726 surrounds cables 702*a*, 702*b*, and 702*c* which, are braided together. Mother shield 726 is connected to the shell of connector 712 by jumper 728. While shields 708 of cables 702*a* and 702*b* have been interconnected in cable assembly 700, any two of the three shields 708 of cables 702*a*, 702*b*, and 702*c* may be interconnected to achieve similar cable performance.

Figure 15:
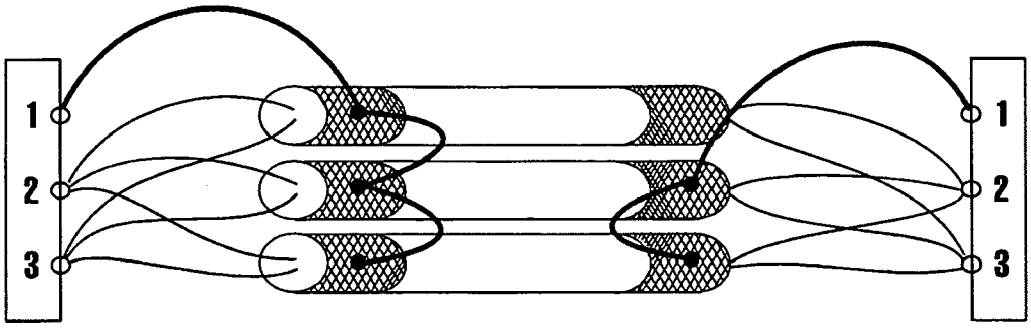
FIG. 15 is a schematic view of an alternate embodiment of a cable in accordance with the invention.
Figure 16:
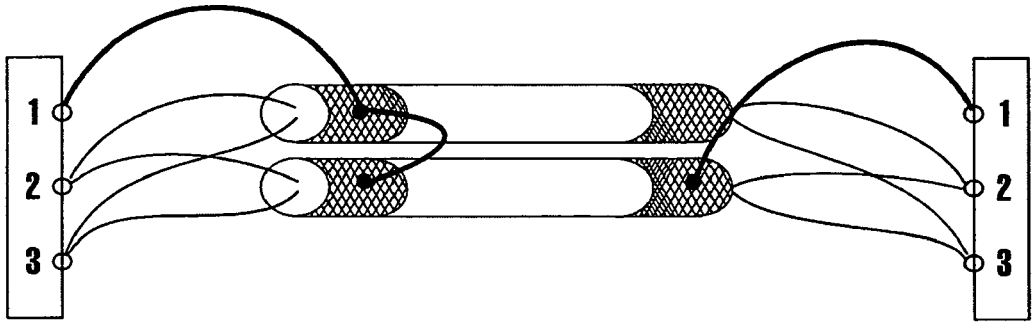
FIG. 16 is schematic view of another alternate embodiment of a cable in accordance with the invention.

Referring now to FIGS. 15 and 16, there are shown schematic representations of two of myriad variations of cable combinations which may be formed in accordance with the invention as has been described hereinabove.

Figure 17:
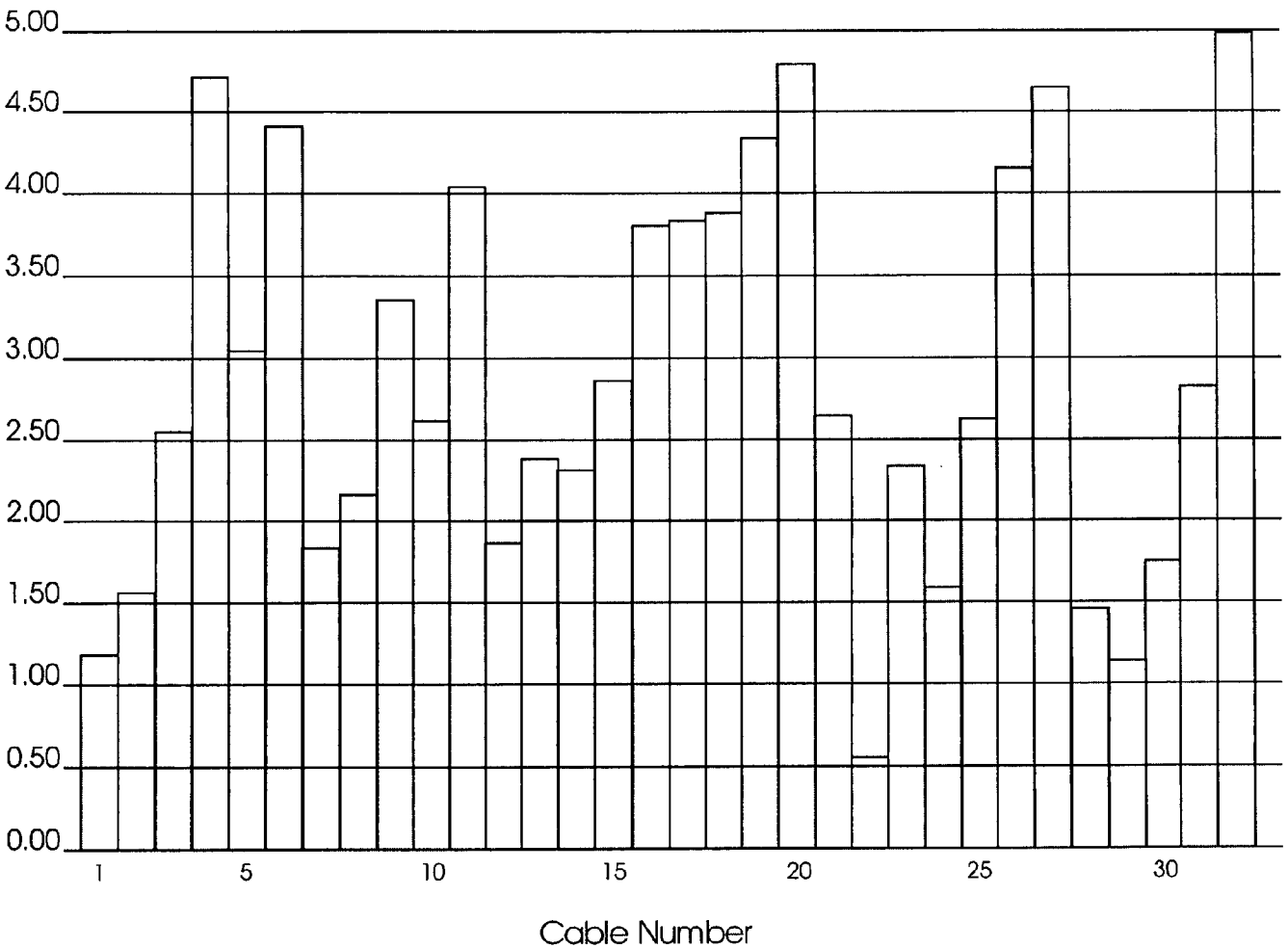
FIG. 17 is a graph showing the relationship between capacitance and inductance in audio interconnect cables of the prior art and of the cable of FIG. 10.

While subjective tests have been used extensively to evaluate cables built in accordance with the present invention, objective measurement results are also provided. Puzzled as to why their novel cables performed subjectively so much better than other prior art cables, a series of tests were undertaken. Referring now to FIG. 17, there is shown a plot where measured capacitance in picofarads (pF) is plotted on the left vertical axis and cable inductance in nanohenries (nH) is plotted on the right vertical axis. Measurements were all normalized to a one meter length of cable. A line is drawn connecting the measured capacitance and measured inductance for each of 31 prior art cables and a cable assembly 304 (FIG. 10) in accordance with the present invention. The 31 prior art cables included cables considered in the audio field to be state-of-the-art and, while not scientifically selected, included every cable available to the inventors for evaluation. As may readily seen, the slope of the lines connecting respective capacitance and inductance values for the 31 prior art cables is upward from left to right. Only cable 304 exhibits a downward slope. This indicates that the structure of cable assembly 304 creates a different ratio of capacitance to inductance than does any measured prior art cable.

Figure 18:
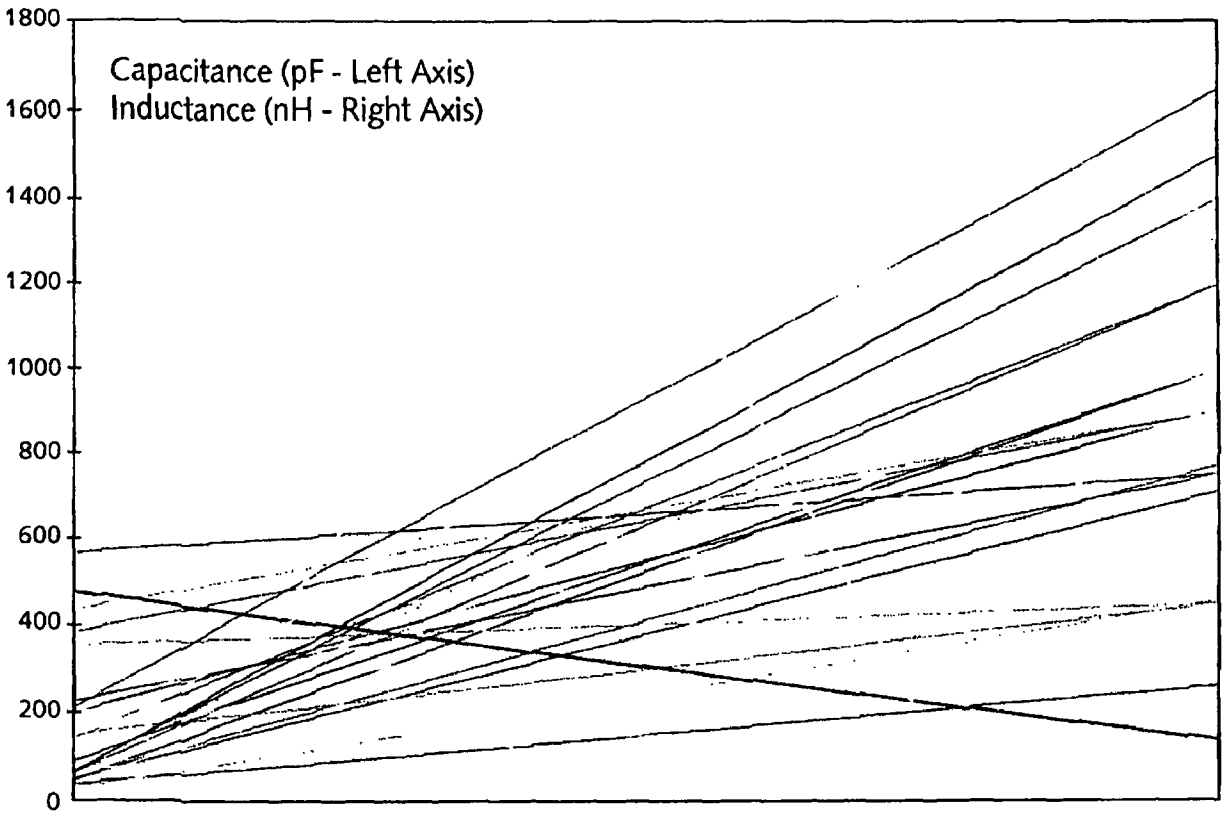
FIG. 18 is a bar graph of the characteristic impedance of the prior art cables of FIG. 17 and the cable of FIG. 10.

Next, the characteristic impedance of each of the 32 cables was measured. FIG. 18 is a bar graph of the characteristic impedance of each of the 32 measured cables. Impedance is computer as the square root of L/C (i.e., inductance divided by capacitance). All impedances are normalized to 1 meter, that is the represented characteristic impedance is for a 1 meter section of each cable. As may readily be seen from FIG. 18, the characteristic impedance of cable 304 is lower than any of the 31 prior art cables measured.

Audio interconnection cables of the prior art are well known to exhibit different performance when interconnecting tube equipment compared to solid-state equipment. For example, a cable may sound acceptable when connecting a tube preamplifier to a tube amplifier. However, the same cable may sound unacceptable when connecting a solid state preamplifier to a solid-state amplifier. To better understand why this is true, the inventors measured the transient (i.e., square wave) response of some the 31 prior art cables of FIGS. 17 and 18. Measurements were made using two different combinations of source and load impedances simulating impedances typically associated with both tube and solid-state equipment. The source impedance used to simulate tube equipment is 250 ohms, the termination impedance is 100K ohms for a balanced configuration and 200K ohms for an unbalanced configuration. The source impedance used to simulate solid-state equipment is 50 ohms and the termination impedance is 10K ohms for a balanced configuration and 20K ohms for an unbalanced configuration. Only the upper portion of the leading edges of each square waves is shown.

Figure 19A:
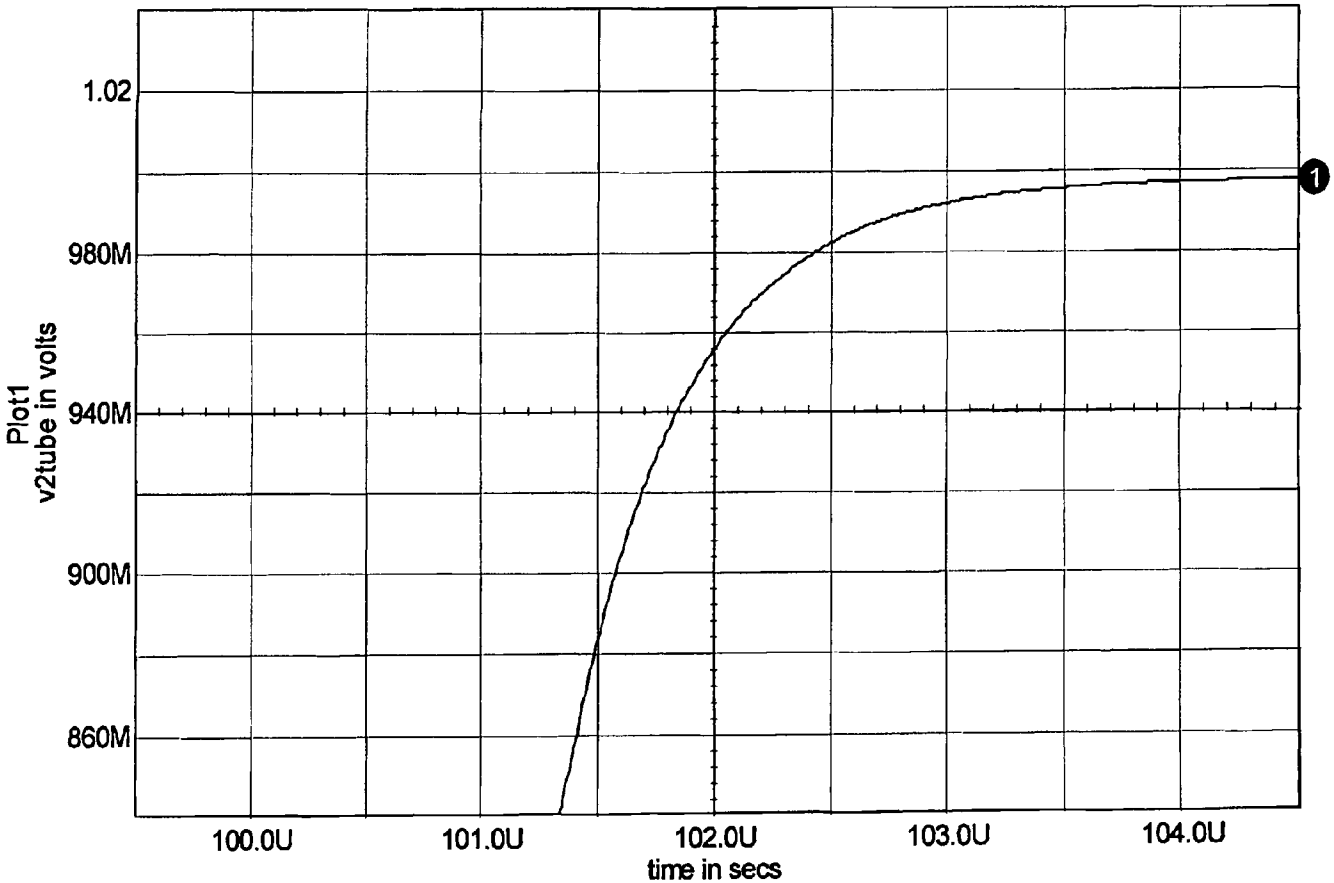
FIGS. 19*a* and 19*b* show an upper corner of the leading edge of the square wave response for a first prior art cable in a balanced configuration for both tube-to-tube and solid-state to solid-state simulations, respectively.
Figure 19B:
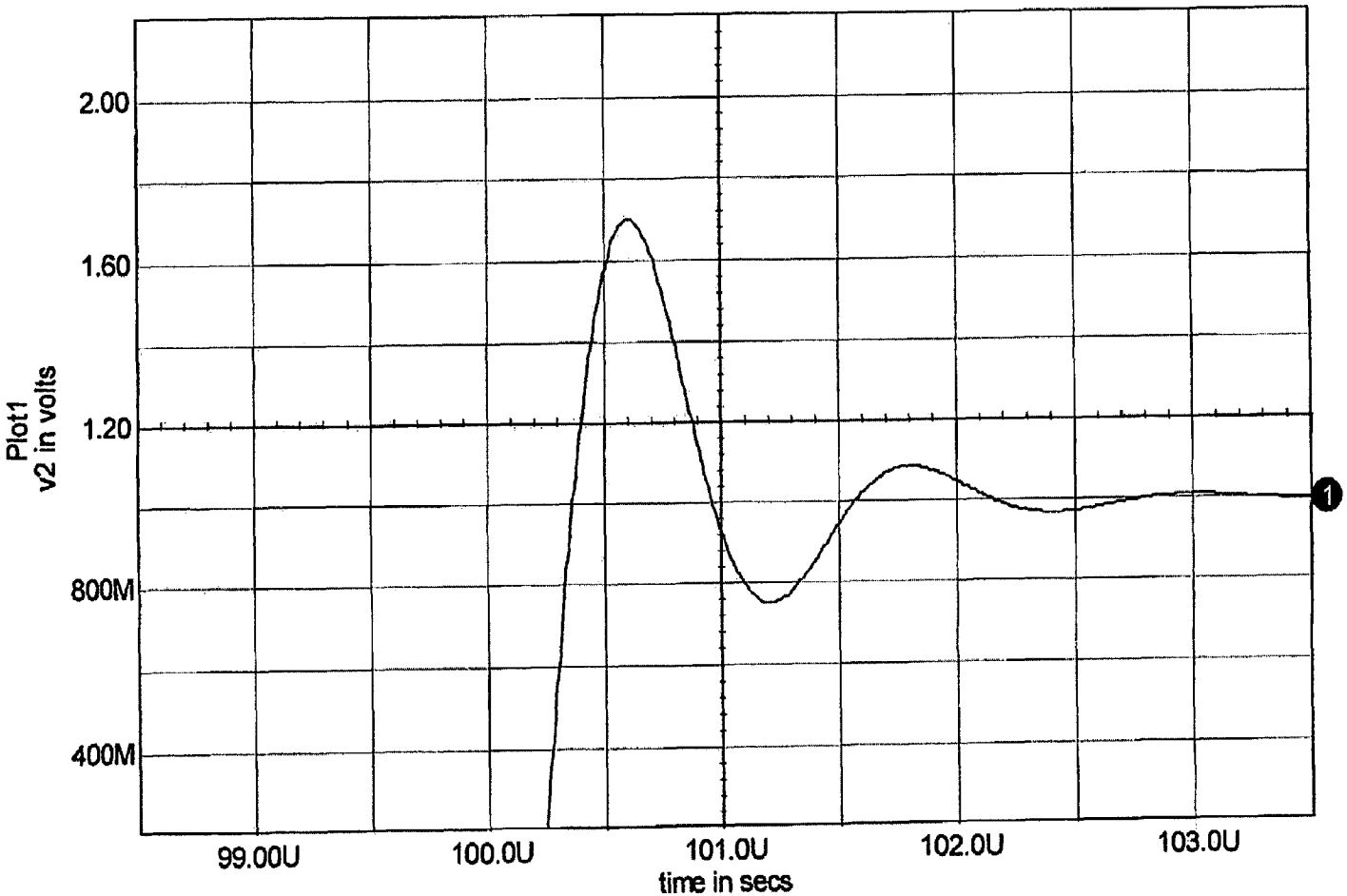

Referring first to FIGS. 19*a* and 19*b*, there are shown portions of leading edges of the square wave response of a first cable of the prior art in a balanced configuration. FIGS. 19*a* and 19*b* show tube-to-tube and solid-state to solid-state responses, respectively. It may be seen that tube-to-tube response yields a relatively square response (FIG. 19*a*) while the solid-state to solid-state response (FIG. 19*b*) shows pronounced ringing.

Figure 20A:
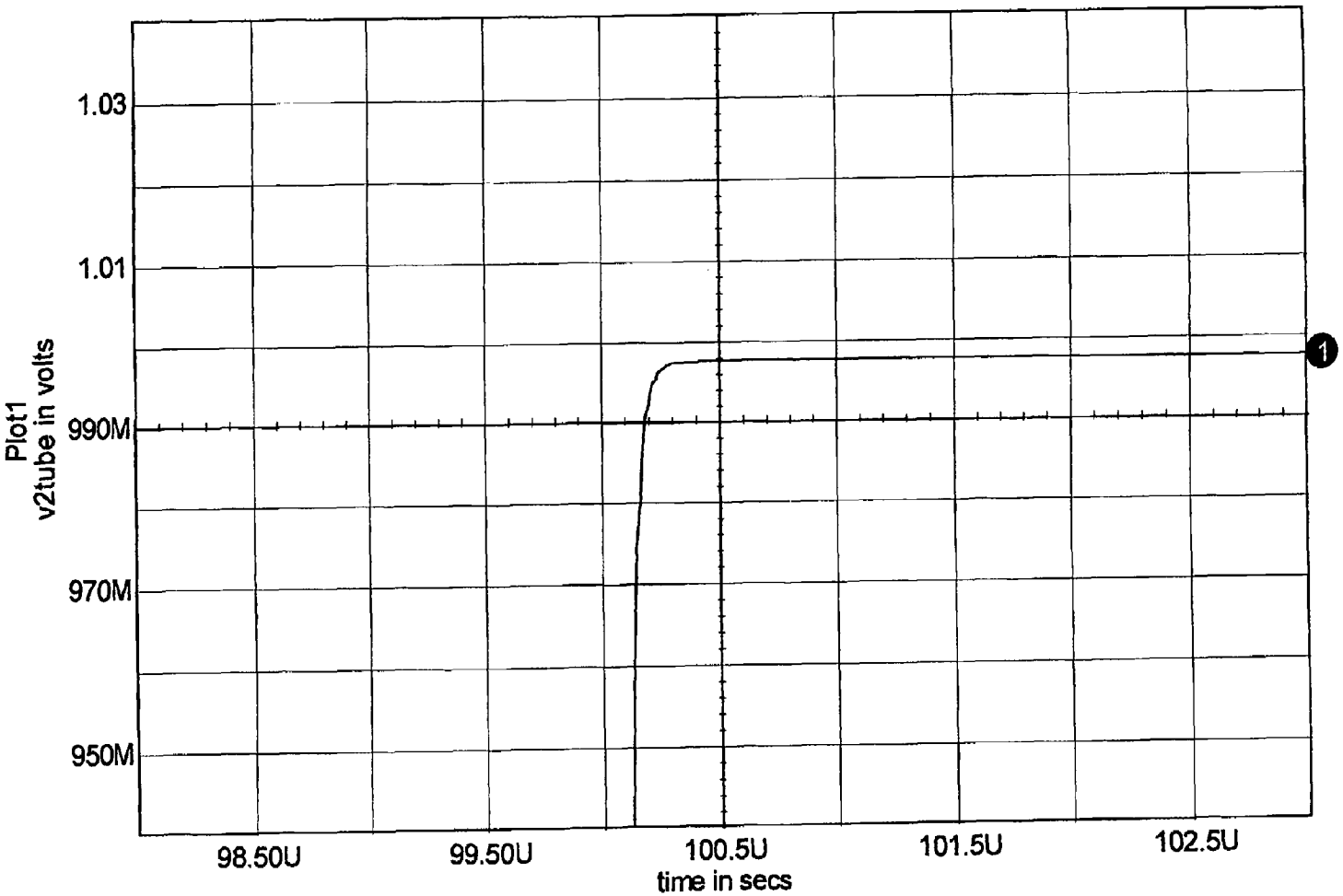
FIGS. 20*a* and 20*b* show an upper corner of the leading edge of the square wave response for a second prior art cable in a balanced configuration for both tube-to-tube and solid-state to solid-state simulations, respectively.
Figure 20B:
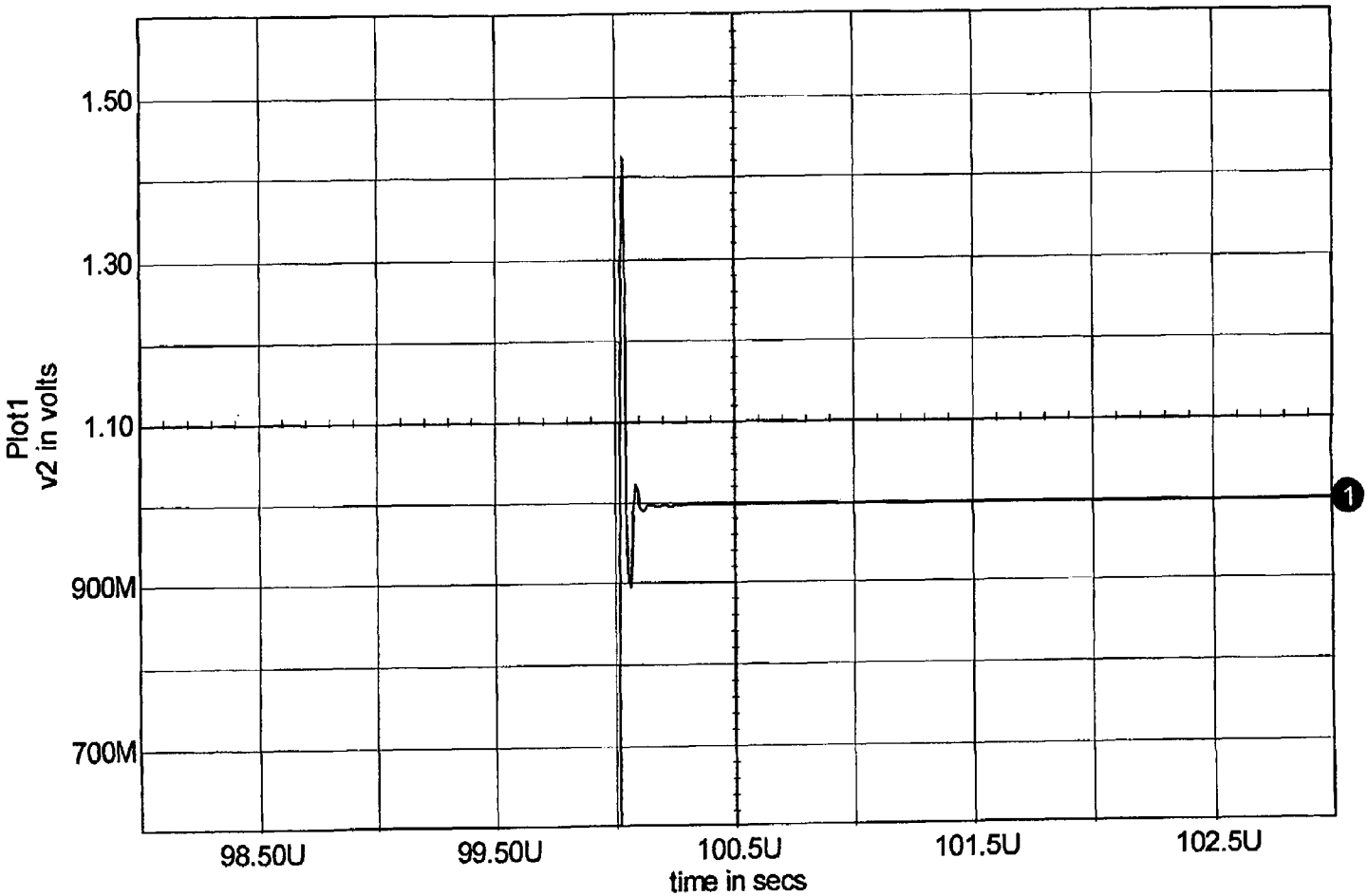

FIGS. 20*a* and 20*b* show similar tube and solid-state performance of a second cable of the prior art. The cable of FIGS. 20*a* and 20*b* is shown for a balanced configuration for both tube-to-tube and solid-state to solid-state usage. As may be seen, in tub-to-tube mode (FIG. 20*a*), there is significant roll-off of the leading edge while for solid-state to solid-state usage the is still significant ringing although the damping appears different than the cable of FIG. 19*b*.

Figure 21A:
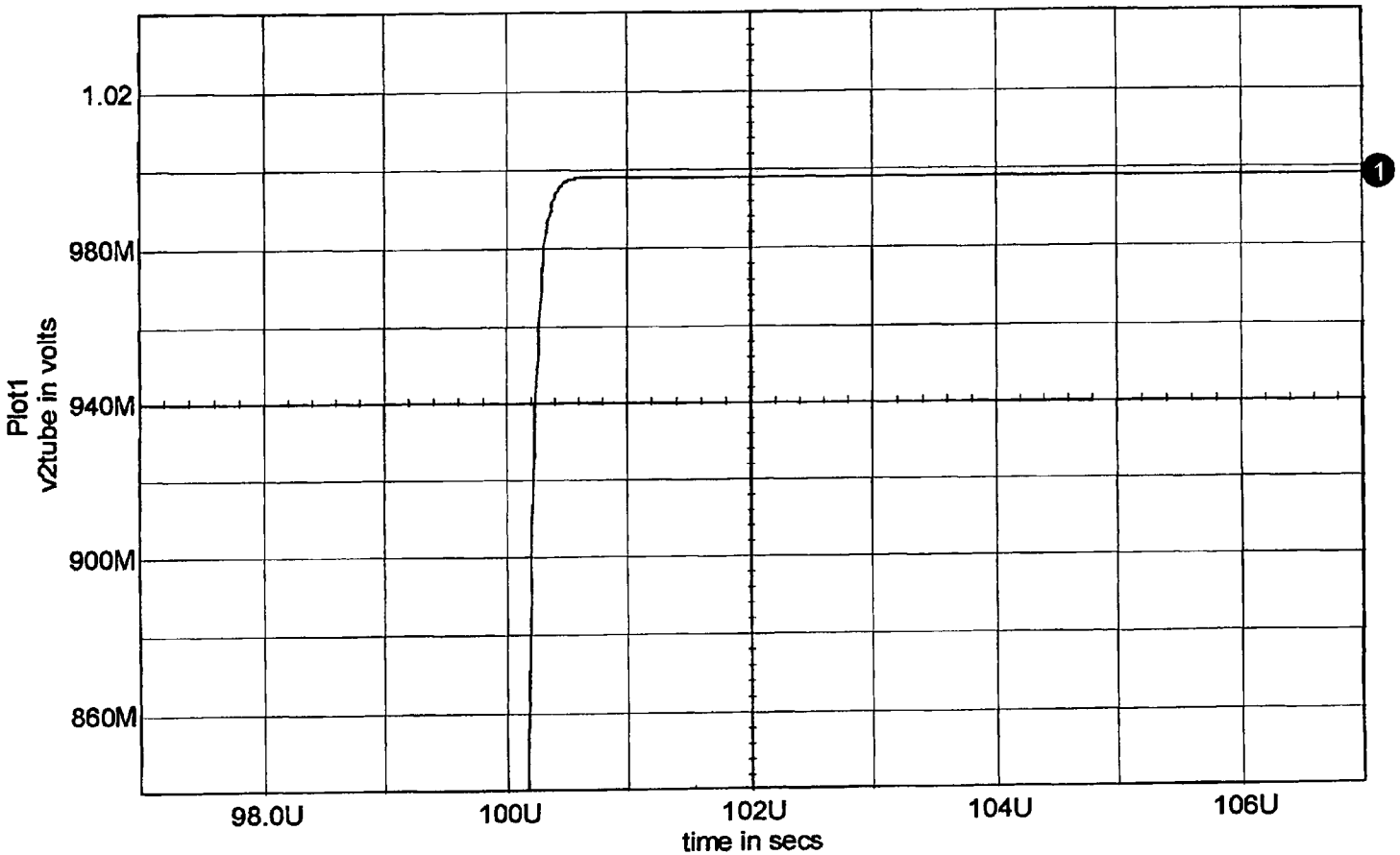
FIGS. 21*a* and 21*b* show an upper corner of the leading edge of the square wave response for a single strand of cable used for constructing cable assembles of the invention, in a balanced configuration for both tube-to-tube and solid-state to solid-state simulations, respectively.
Figure 21B:
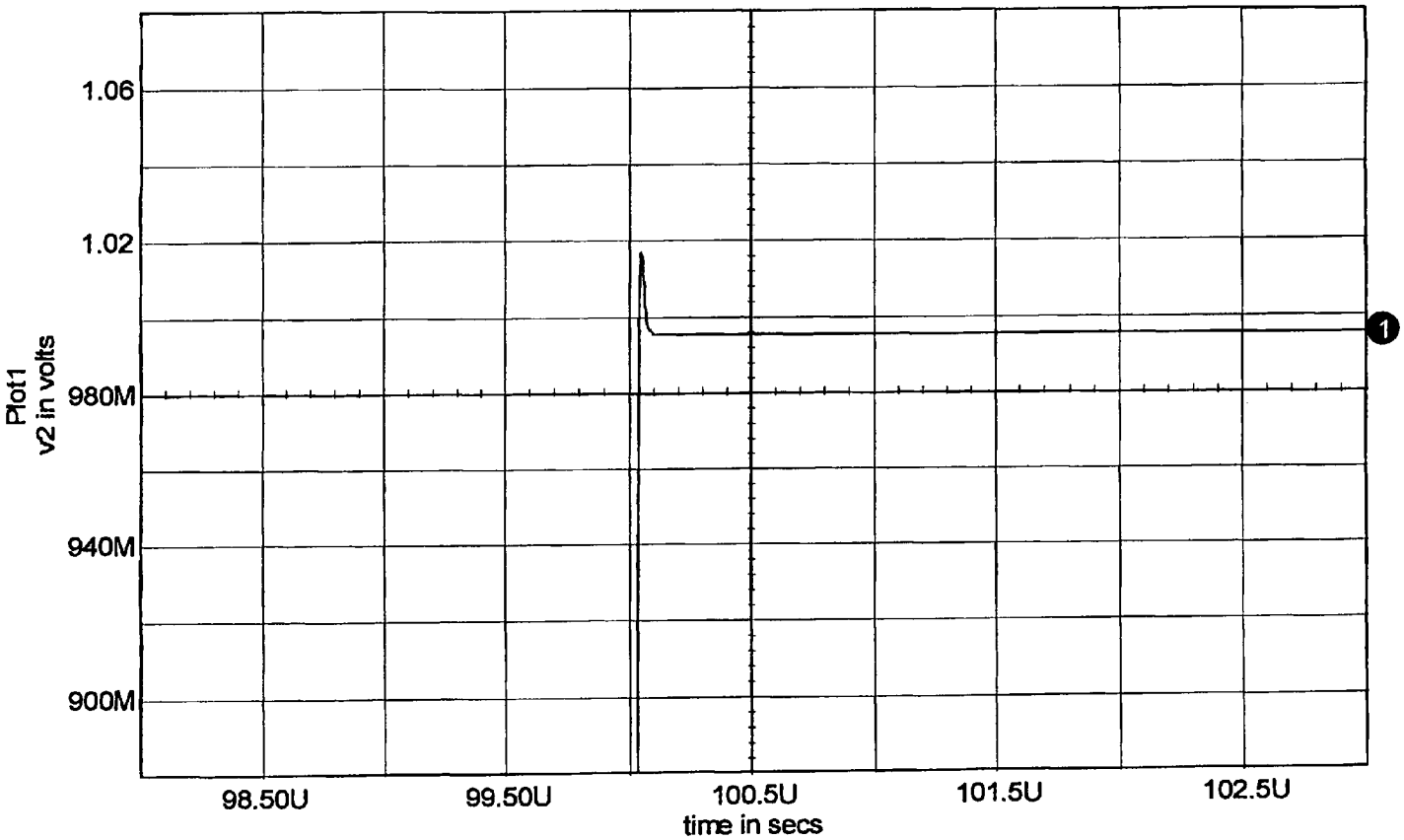

Referring now to FIGS. 21*a* and 21*b*, there are shown tub-to-tube and solid-state to solid-state square wave responses, respectively, of a single strand of the material from which the inventive cables are constructed. As may be seen, the single strand of cable in tube-to-tube simulation (FIG. 21*a*) shows a slight roll-off but has a substantially square corner. The solid-state to solid-state response (FIG. 21*b*) exhibits a slight overshoot but still otherwise has a substantially square corner.

Figure 22A:
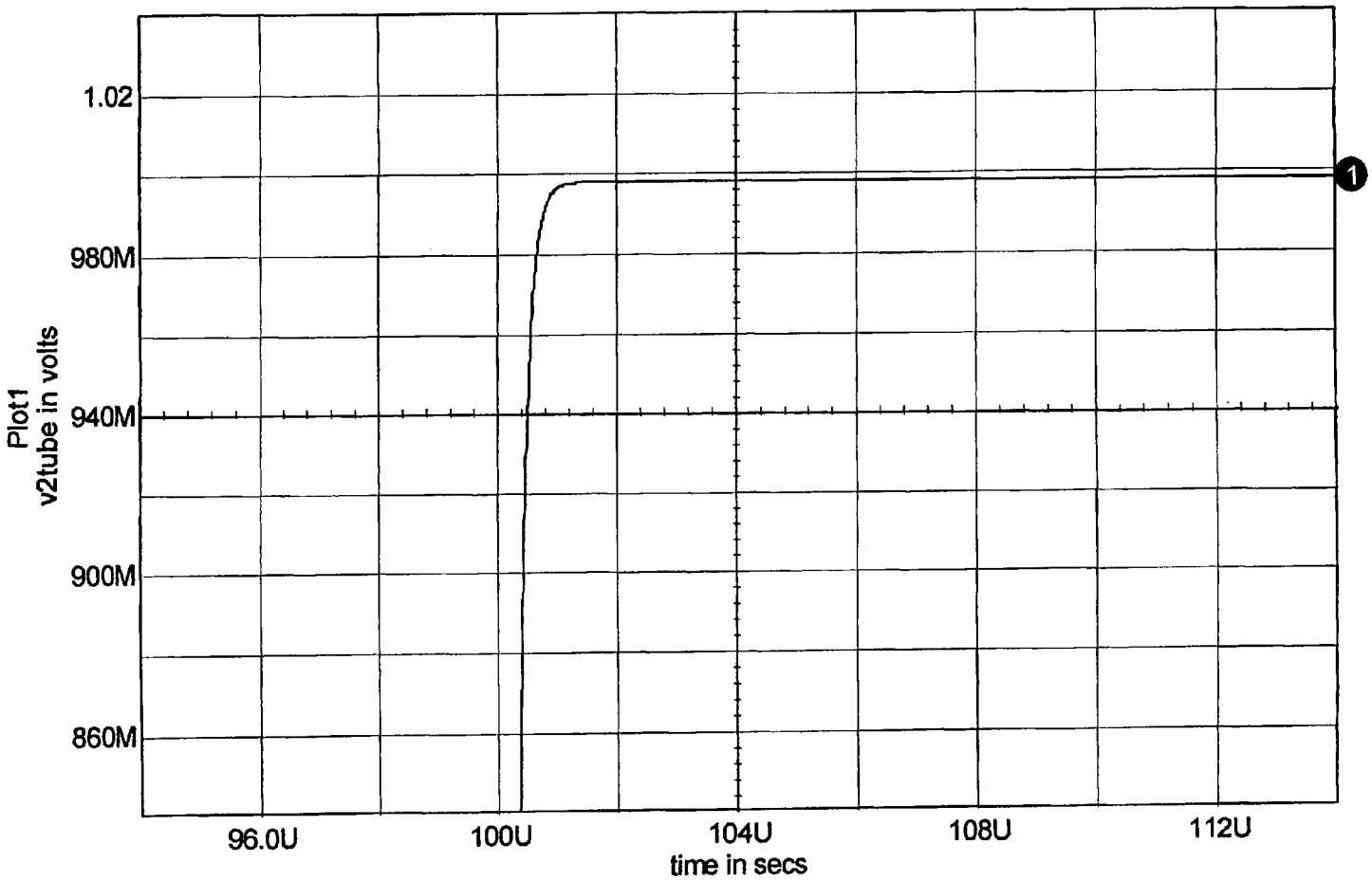
FIGS. 22*a* and 22*b* show an upper corner of the leading edge of the square wave response for cable of FIG. 10*a* in a balanced configuration for both tube-to-tube and solid-state to solid-state simulations, respectively.
Figure 22B:
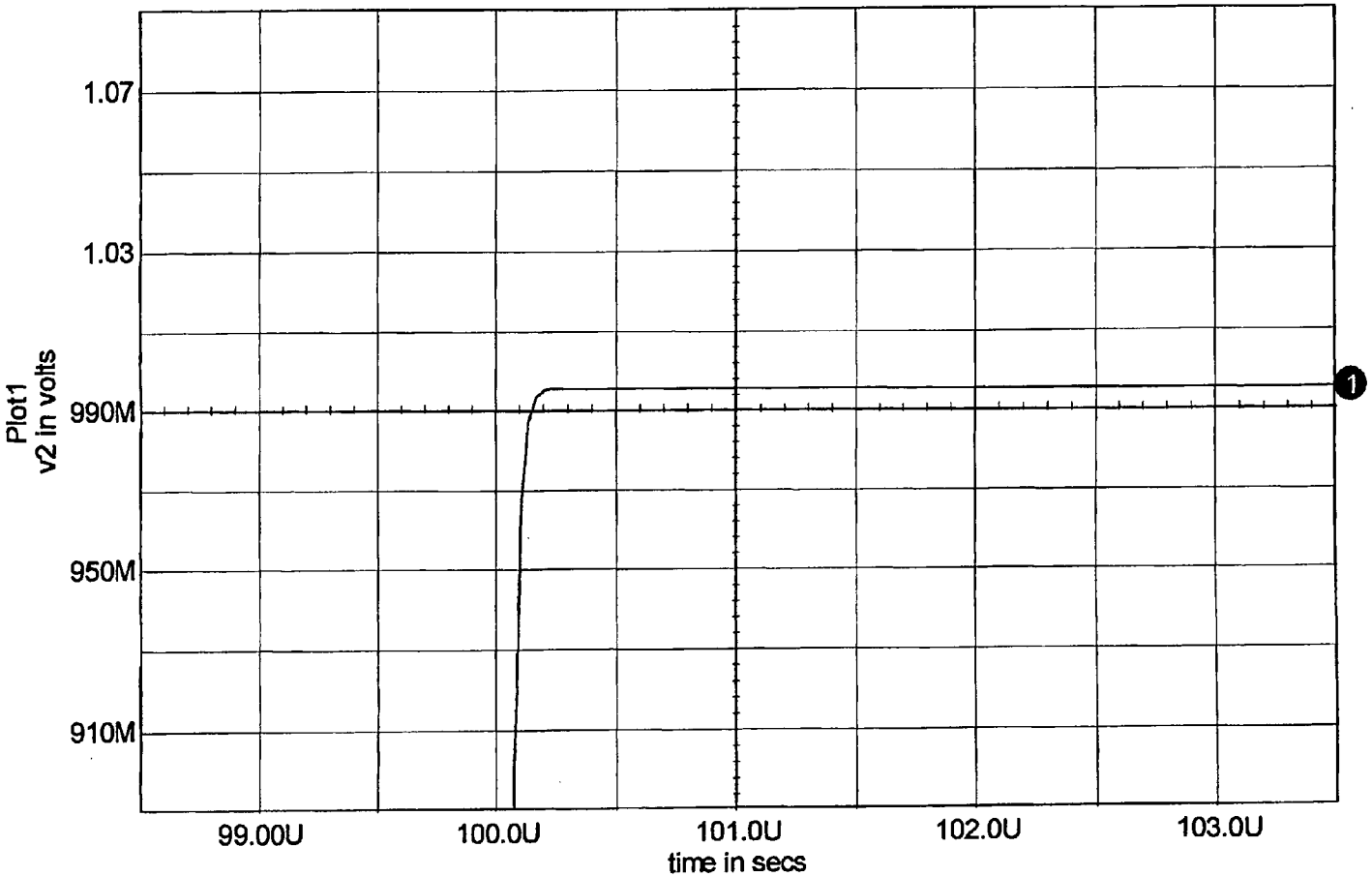

Referring now to FIGS. 22*a* and 22*b* there are shown tube-to-tube and solid-state to solid-state square wave responses, respectively, of cable 304 (FIG. 10) in accordance with in invention in a balanced configuration. The individual cables runs are from the cable whose response is shown in FIGS. 21*a* and 21*b*. Unlike cables of the prior art, cable 304 exhibits excellent and substantially identical performance for both tube-to-tube (FIG. 22*a*) and solid-state to solid-state (FIG. 22*b*) simulations.

Figure 23A:
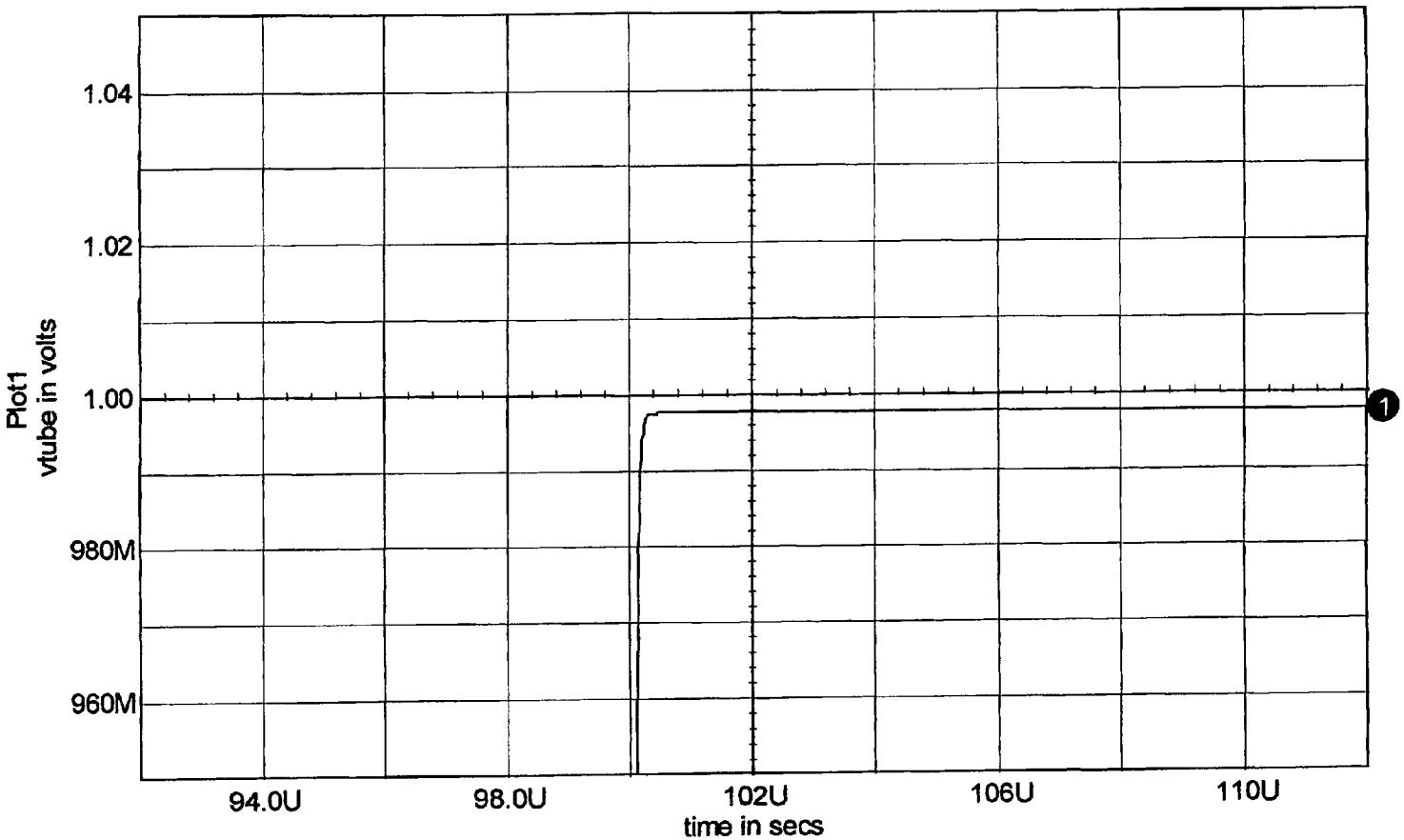
FIGS. 23*a* and 23*b* show an upper corner of the leading edge of the square wave response for a third prior art cable in an unbalanced configuration for both tube-to-tube and solid-state to solid-state simulations, respectively.
Figure 23B:
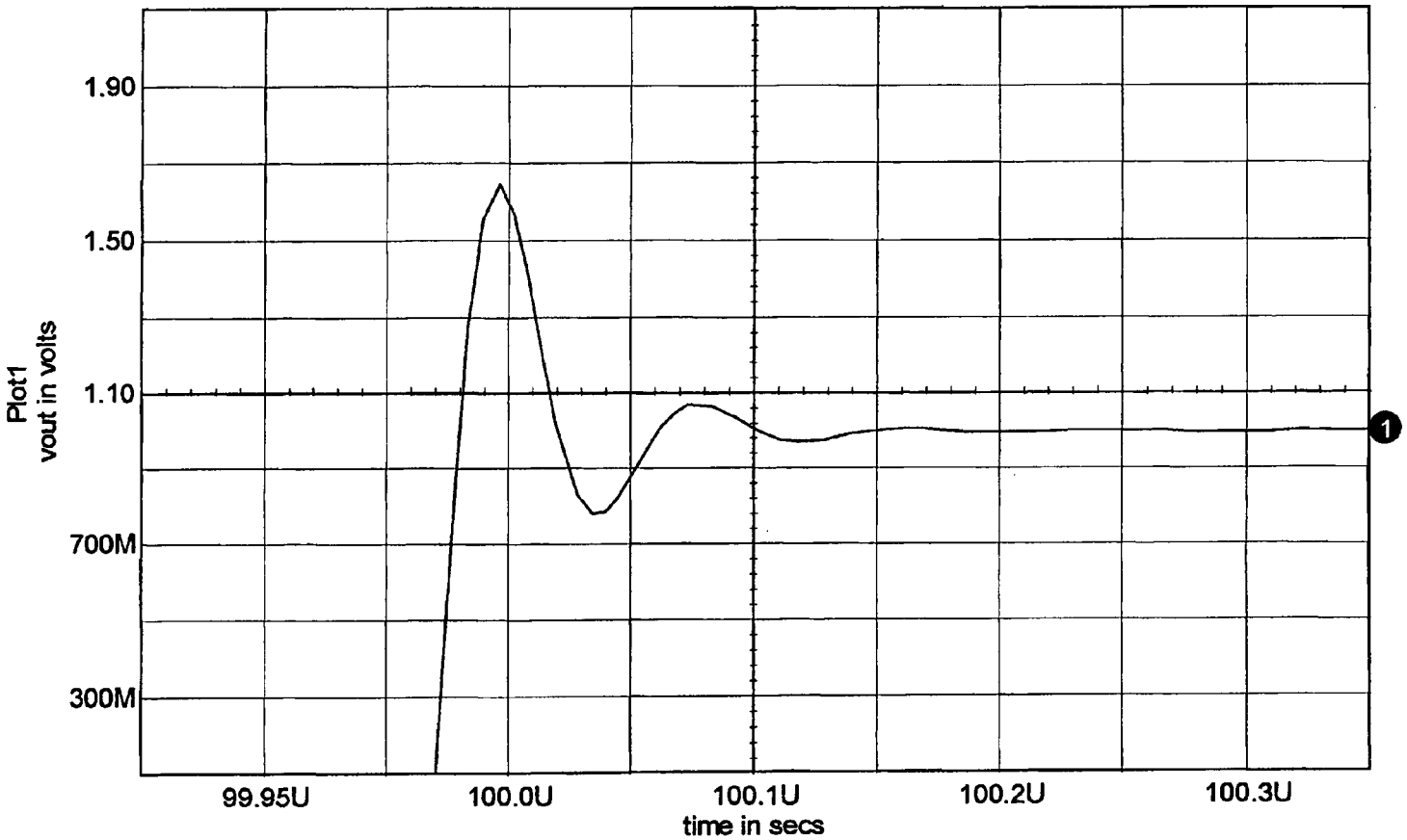

Similar test results were obtained for unbalanced configurations. FIGS. 23*a* and 23*b* provide tube-to-tube and solid-state to solid-state square wave responses, respectively, for a cable of the prior art in an unbalanced configuration. As may be seen, the cables performance in the tube-to-tube simulation (FIG. 23*a*) is good. However, the same cables performance in the solid-state to solid-state simulation is poor.

Figure 24A:
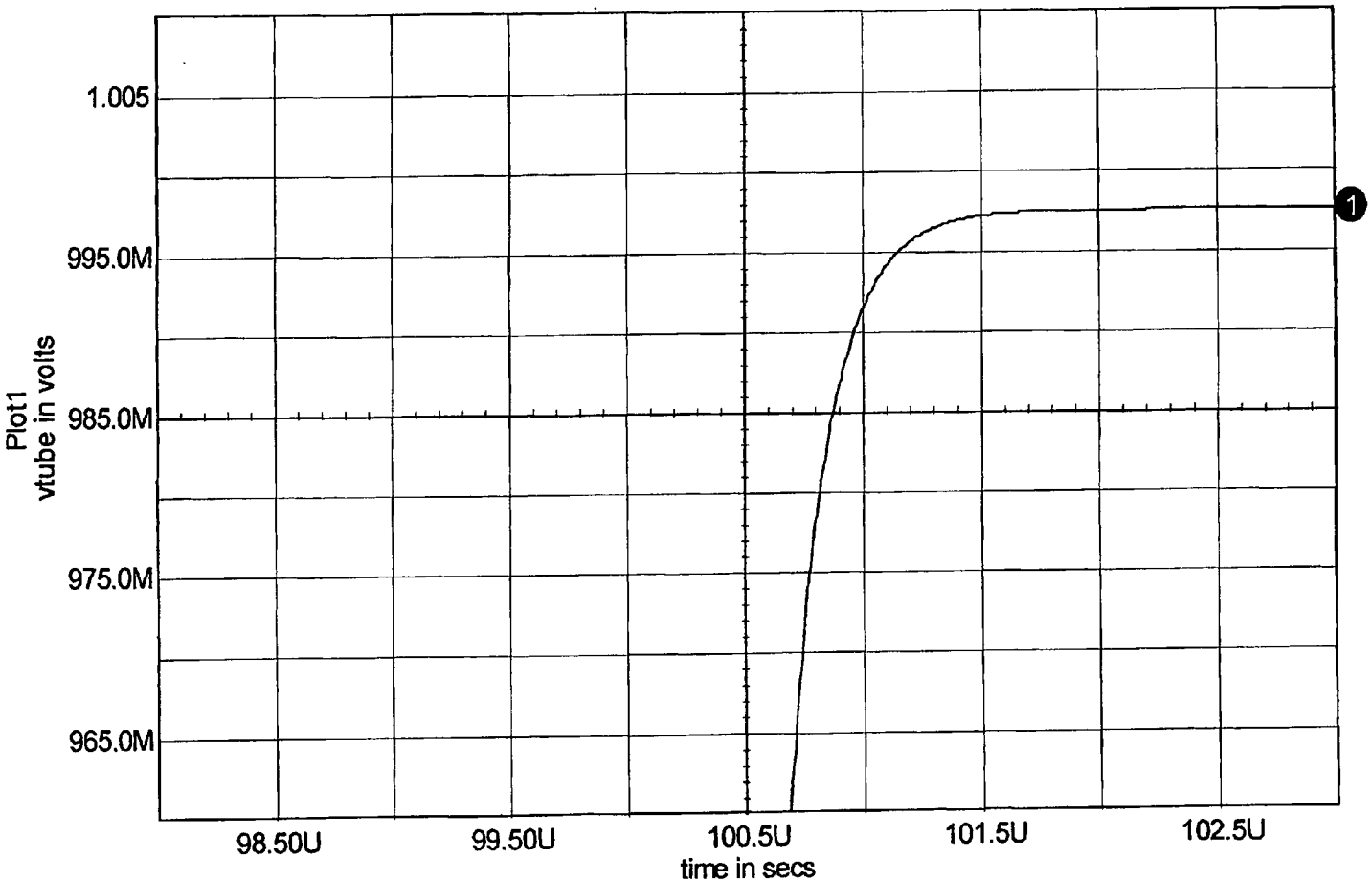
FIGS. 24*a* and 24*b* show an upper corner of the leading edge of the square wave response for a single strand of cable used for constructing cables assembles of the invention, in an unbalanced configuration for both tube-to-tube and solid-state to solid-state simulations, respectively.
Figure 24B:
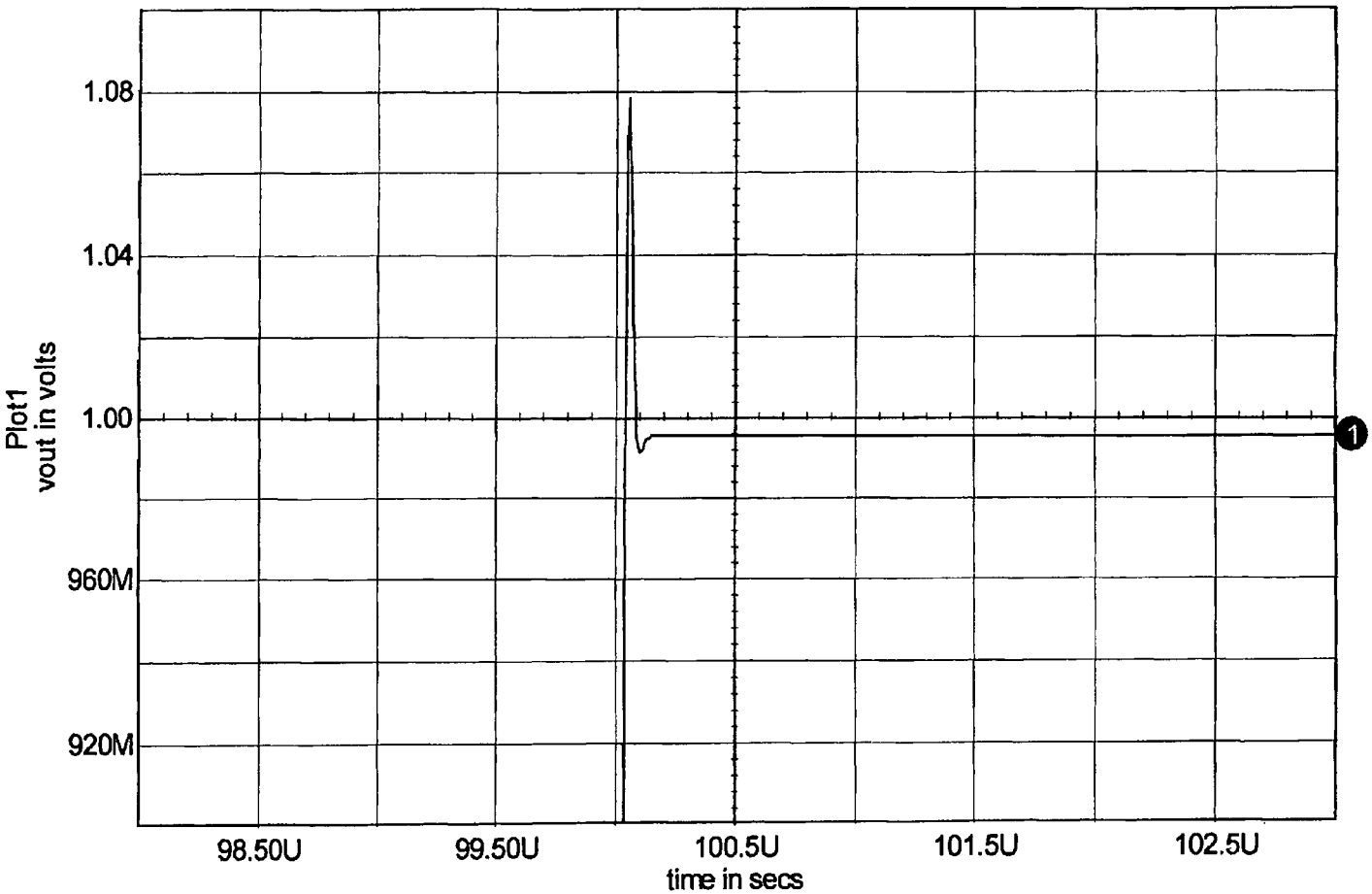

FIGS. 24*a* and 24*b* show tube-to-tube and solid-state to solid-state square wave responses, respectively for a single strand of cable used to construct the cable 500 (FIG. 12*a*). The tube-to-tube response (FIG. 24*a*) shows significant roll-off while the solid-state to solid-sate response (FIG. 24*b*) shows significant overshoot.

Figure 25A:
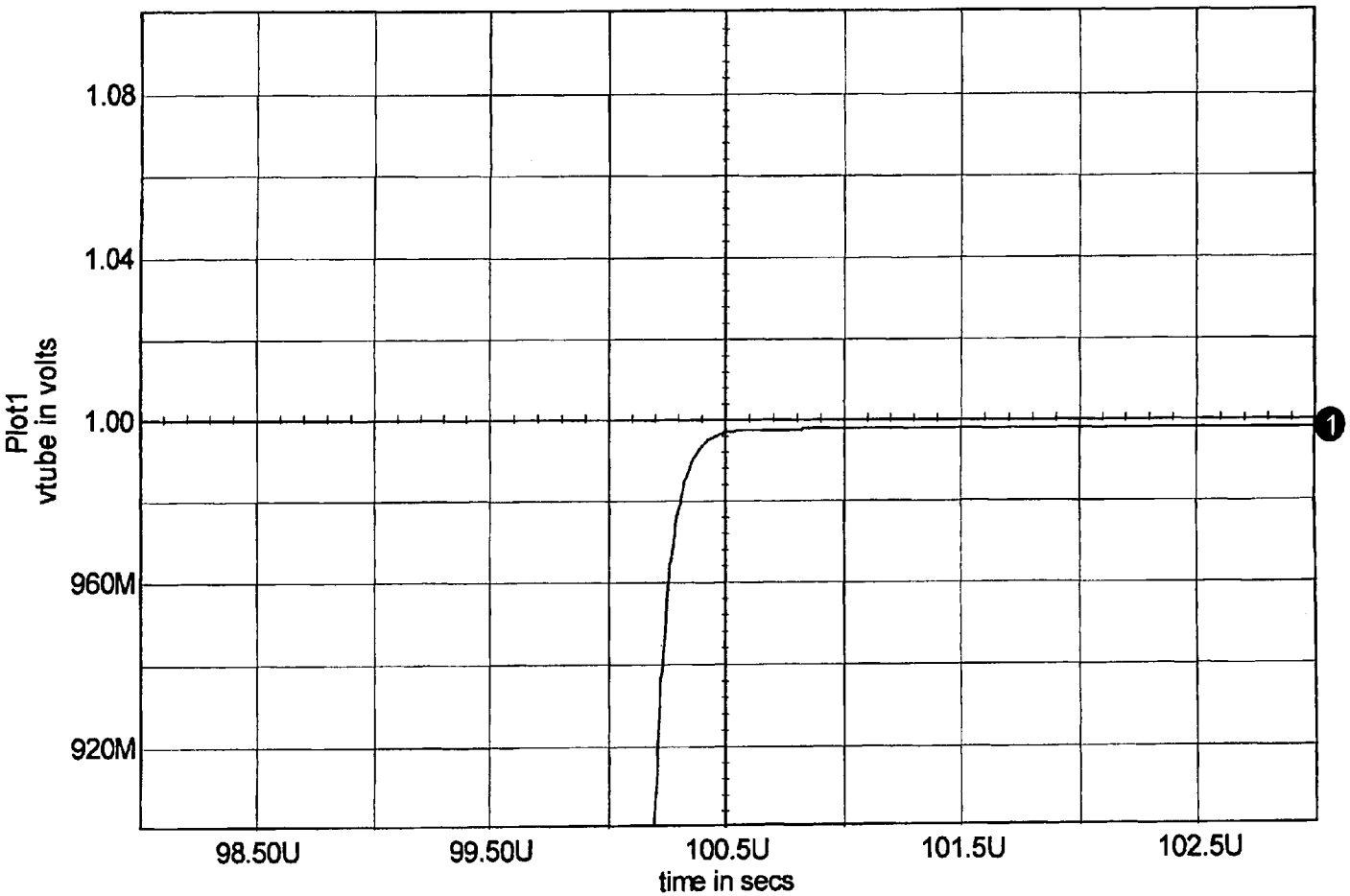
FIGS. 25*a* and 25*b* show an upper corner of the leading edge of the square wave response for cable of FIG. 12*a* in an unbalanced configuration for both tube-to-tube and solid-state to solid-state simulations, respectively.
Figure 25B:
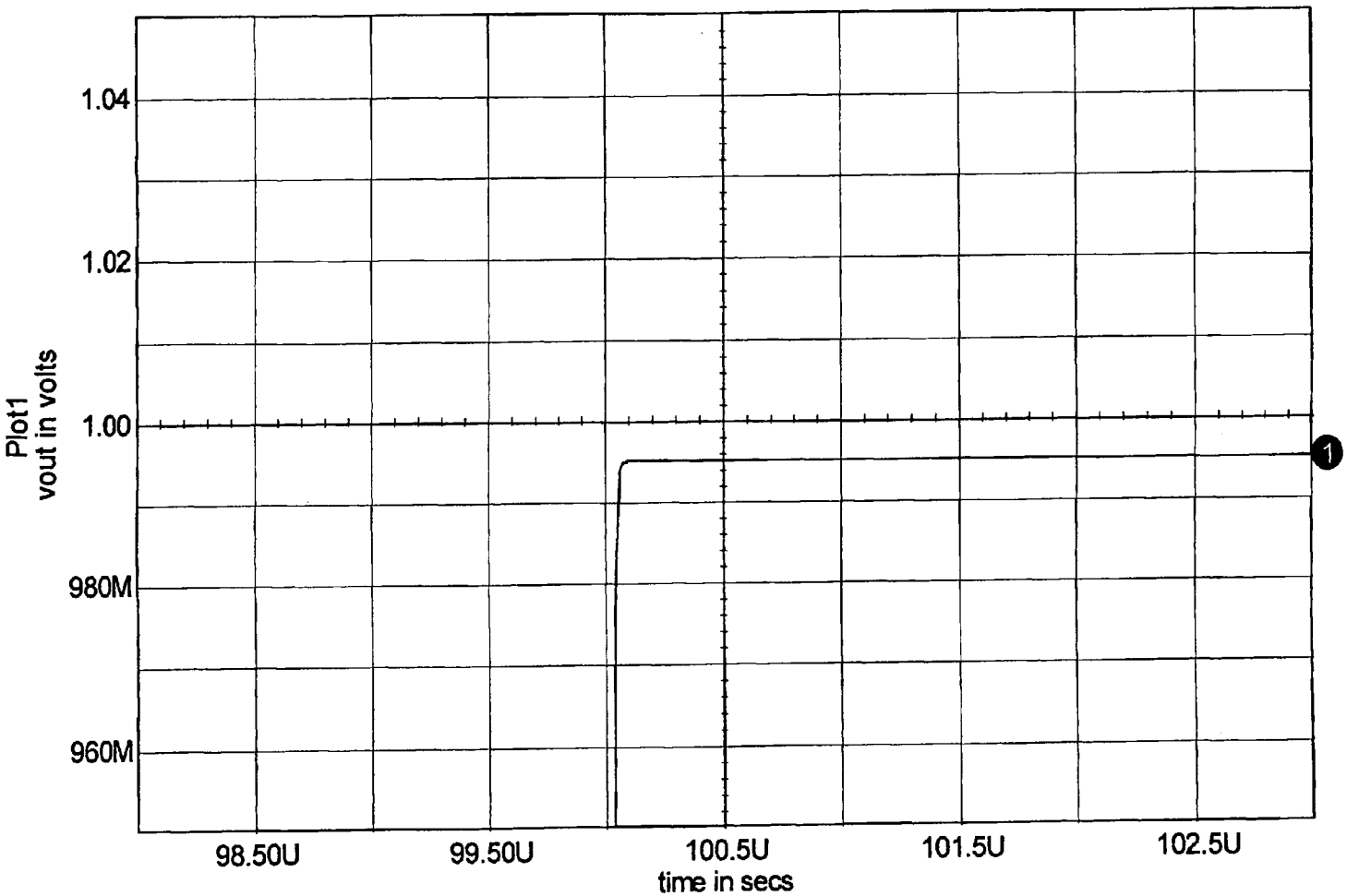

When the cable of FIGS. 24*a* and 24*b* is assembled into cable assembly 500 (FIG. 12*a*), the results are significantly different. FIGS. 25*a* and 25*b*, respectively, show the tube-to-tube response and solid-state to solid-state response of cable assembly 500. Both the tub-to-tube (FIG. 25*a*) and solid-state to solid-state response (FIG. 25*b*) are excellent and consistent, the tube-to-tube response s (FIG. 25*a*) showing slight roll-off on an otherwise substantially square corner.

Listening tests, as discussed hereinabove, have shown cables built in accordance with the inventive principles to exhibit superb audio performance. This performance is substantiated by the results of the tests reported herein.

While the primary focus of the disclosure has been audio cables, the inventors have demonstrated like signal transmission improvements in cables designed for video and data (i.e., digital signals) and the invention is not considered limited to the field of application chosen for purposes of disclosure. It will also be recognized that the inventive concepts may be expanded to include additional cable runs in cable assemblies, additional conductors in each cable, as well as to other combinations of shield termination at one or both ends of the cable assemblies. Likewise, the invention is not considered limited to the particular geometries chosen for purposes of disclosure.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A cable assembly for interconnecting an electrical device having a two-terminal output, to another electrical device having a two-terminal input, said two-terminal input and said two-terminal output each comprising at least a first terminal, and a second terminal, said cable assembly comprising:

a plurality of, discrete, insulated electrical cables each having at least one pair of insulated conductors, a first one of said insulated conductors of a first one of said plurality of discrete insulated electrical cables being connected to at least one of: said first terminal at each of said two-terminal input and said two-terminal output, and said second terminal at each of said two-terminal input and said two-terminal output, and a second one of said insulated conductors of said first one of said plurality of discrete insulated electrical cables being connected to a different one of: said first terminal at each of said two-terminal input and said two-terminal output, and said second terminal at each of said two-terminal input and said two-terminal output, and at least one of said pair of insulated electrical conductors of another one of said discrete insulated electrical cables also being connected to one of said first terminal at each of said two-terminal input and said two-terminal output, and said second terminal at each of said two-terminal input and said two-terminal output.

2. The cable assembly as recited in claim 1, wherein said first terminal is designated with a label selected from the group: a center pin, a positive terminal, a ground shell, and a negative terminal, and wherein said second terminal is designated with a different label selected from the group: center pin, a positive terminal, a ground shell, and a negative terminal.

3. The cable assembly as recited in claim 1, wherein said at least one pair of insulated electrical conductors comprises a twisted pair of insulated electrical conductors.

4. The cable assembly as recited in claim 1, wherein said plurality of discrete electrical cables are interrelated in at least one of the ways: braided together, and twisted together.

5. The cable assembly as recited in claim 1, further comprising an electrically conductive mother shield at least a portion of which is configured and dimensioned to surround said plurality of discrete electrical cables, said mother shield being electrically connected to least one of: a ground connection independent of said first terminal and said second terminal, said first terminal of at least one of said two-terminal input and said two-terminal output, and said second terminal of at least one of said two-terminal input and said two-terminal output.

6. The cable assembly as recited in claim 5, wherein the mother shield is configured and dimensioned to substantially completely surround said plurality of discrete electrical cables.

7. The cable assembly as recited in claim 1, wherein said-plurality of, discrete, insulated electrical cables comprise shields, said shields of said plurality of discrete, insulated electrical cables being electrically connected to at least one of: a ground connection independent of said first terminal and said second terminal, said first terminal of at least one of said two-terminal input and said two-terminal output, and said second terminal of at least one of said two-terminal input and said two-terminal output, according to at least one of the following shield connection topologies: at least one shield is electrically connected at at least one of said two-terminal input and said two-terminal output; at least one shield is electrically connected to at least one other shield and said interconnected shields are connected at least one of said two-terminal input and said two-terminal output; and at least one shield is electrically connected to at least one other shield and said interconnected shields are connected at said two-terminal input and at least one, but not all, of said interconnected shields are connected to said two-terminal output.

8. The cable assembly as recited in claim 7, wherein said first terminal is designated with a label selected from the group: a center pin, a positive terminal, a ground shell, and a negative terminal, and wherein said second terminal is designated with a different label selected from the group: center pin, a positive terminal, a ground shell, and a negative terminal.

9. The cable assembly as recited in claim 7, wherein said at least one pair of insulated electrical conductors comprises a twisted pair of insulated electrical conductors.

10. The cable assembly as recited in claim 7, wherein said plurality of discrete electrical cables are interrelated in at least one of the ways: braided together, and twisted together.

11. The cable assembly as recited in claim 7, further comprising an electrically conductive mother shield at least a portion of which is configured and dimensioned to surround said plurality of discrete electrical cables, said mother shield being electrically connected to least one of: a ground connection independent of said first terminal and said second terminal, said first terminal of at least one of said two-terminal input and said two-terminal output, and said second terminal of at least one of said two-terminal input and said two-terminal output.

12. The cable assembly as recited in claim 11, wherein the mother shield is configured and dimensioned to substantially completely surround said plurality of discrete electrical cables.

* * * * *